US006520342B1

(12) United States Patent
Dumke et al.

(10) Patent No.: US 6,520,342 B1
(45) Date of Patent: Feb. 18, 2003

(54) PRODUCT HANDLING APPARATUS

(75) Inventors: Robert D. Dumke, Colgate, WI (US); Edward R. Horn, Oconomowoc, WI (US); Gerald A. Kohlman, Oconomowoc, WI (US); John Wolf, Colgate, WI (US); Mike Gross, Kewaskum, WI (US); Todd Sherbinow, Colgate, WI (US); Mark Troeger, Muskego, WI (US)

(73) Assignees: Aladdin Engineering & Manufacturing, Inc., Waukesha, WI (US); Professional Control Corporation, Germantown, WI (US)

( * ) Notice: Subject to any disclaimer, the term of this patent is extended or adjusted under 35 U.S.C. 154(b) by 0 days.

(21) Appl. No.: 09/505,426

(22) Filed: Feb. 16, 2000

(51) Int. Cl.[7] ..... B07C 5/02

(52) U.S. Cl. ..... 209/539; 209/583; 209/644; 209/900; 209/932

(58) Field of Search ..... 209/539, 559, 209/583, 587, 639, 644, 900, 932

(56) References Cited

U.S. PATENT DOCUMENTS

| | | | |
|---|---|---|---|
| 1,146,850 | A | 7/1915 | Cullum |
| 2,585,045 | A | 2/1952 | Schmidlin |
| 2,728,564 | A | 12/1955 | Bracke |
| 2,959,188 | A | 11/1960 | Kepner |
| 3,004,549 | A | 10/1961 | Temple |
| 3,229,721 | A | 1/1966 | Bingel |
| 3,335,750 | A | 8/1967 | Kepner |
| 3,792,715 | A | 2/1974 | Parrett et al. |
| 3,817,154 | A | 6/1974 | Martin |
| 3,975,987 | A | 8/1976 | Panis |
| 3,980,336 | A | 9/1976 | Bitonti |
| 4,018,136 | A | 4/1977 | Kaetterhenry |
| 4,072,087 | A | 2/1978 | Mueller |
| 4,073,311 | A | 2/1978 | McGeachy |
| 4,103,699 | A | 8/1978 | Vik |

(List continued on next page.)

FOREIGN PATENT DOCUMENTS

| | | | | |
|---|---|---|---|---|
| JP | 54-17258 | * | 2/1979 | ..... 209/583 |
| JP | 57 65403 | A | 4/1982 | |

OTHER PUBLICATIONS

Hydraulic and Pneumatic Check and Relief Check Valves, Kepner Products Company, 995 N. Ellsworth Ave, Villa Park, IL 60181.

*Primary Examiner*—Tuan N. Nguyen
(74) *Attorney, Agent, or Firm*—Michael Best & Friedrich LLP

(57) ABSTRACT

A product handling apparatus, components of a product handling apparatus, a method of handling products and a software program for controlling a product handling apparatus. The apparatus includes an induct area, in which products are inducted or fed, either automatically or manually, into the product handling apparatus, an identification area, in which the product configuration, the product type and the product title are identified, a labeling area, in which product labels are printed, applied to each product and verified, and a product sorting area, in which the products are sorted into the individual customer order product collection locations for packaging and shipment to the customer. In the product sorting area, products are diverted by air knife diverter mechanisms, and stackable products are stacked in stacker assemblies. An "endless" main conveyor assembly conveys products from the induct area, through the product handling apparatus, to the product sorting area. A main controller electronically communicates with and controls, through the software program, the components of the product handling apparatus.

38 Claims, 18 Drawing Sheets

U.S. PATENT DOCUMENTS

| | | | | | |
|---|---|---|---|---|---|
| 4,171,007 | A | | 10/1979 | Bouteille | |
| 4,172,582 | A | | 10/1979 | Bobnar | |
| 4,192,338 | A | | 3/1980 | Gerulis | |
| 4,287,812 | A | | 9/1981 | Iizumi | |
| 4,531,449 | A | | 7/1985 | Reith | |
| 4,624,445 | A | | 11/1986 | Putnam | |
| 4,667,570 | A | | 5/1987 | Jensen, Jr. et al. | |
| 4,742,849 | A | | 5/1988 | Prudhomme et al. | |
| 4,838,306 | A | | 6/1989 | Horn et al. | |
| 5,081,904 | A | | 1/1992 | Horn et al. | |
| 5,119,954 | A | * | 6/1992 | Svyatsky et al. | 209/900 X |
| 5,207,331 | A | * | 5/1993 | Teegarden et al. | 209/583 X |
| 5,755,336 | A | * | 5/1998 | Rudy | 209/539 |
| 5,819,954 | A | * | 10/1998 | Lacriola | 209/644 X |

* cited by examiner

PRODUCT HANDLING APPARATUS

BACKGROUND OF THE INVENTION

The present invention relates to a product handling apparatus and, more particularly, to a product handling apparatus for labeling and sorting products.

Products, such as, for example, compact discs (CDs), cassette tapes, video cassettes and digital video discs (DVDs), are stored in vast quantities in large warehouses. The products are typically stored in warehouse locations by product type and product title.

A customer generally orders a certain number of product types and product titles. To fill a customer order, the product distributor must gather or pick the specific number of ordered product types and product titles from the various warehouse locations. If the products are not sorted during picking, the distributor will sort the products into the different customer orders and package the products for shipment to each customer. In addition, some distributors print and apply customer specific labels to the products.

In some cases, the order filling process is completed manually. The distributor manually gathers and sorts the products into different customer orders, prints and manually applies labels to the products, as necessary, and then packages the products in a customer order for shipment to that customer.

In other cases, a product handling apparatus is used to complete some steps in the order filling process. For example, after the products in a customer order are manually gathered and sorted into the customer order, a labeling apparatus is used to print and apply a label to each product and to restack the products in the same customer order.

In other product handling apparatus, the products of several customer orders may be sorted and labeled at one time. In such apparatus, the products are conveyed in a flat orientation on a conveyor belt to maintain the stability of the products on the conveyor belt during transport, labeling and sorting. To sort the products, a mechanical diverter mechanism enters the product stream and engages designated products to divert the products into an associated customer order product collection location. The mechanical diverter mechanism must then be moved out of the product stream to allow other non-designated products to pass the associated product collection location so that those products can be diverted into subsequent customer order product collection locations.

In these product handling apparatus, when products are diverted into a customer order product collection location, the products are typically jumbled and disorganized. An operator collects the products from the location and organizes and arranges the products for packaging and shipment to the customer.

SUMMARY OF THE INVENTION

One problem with the above-described manual order filling process is that this manual process is very time-consuming and labor-intensive.

One problem with the above-described product labeling apparatus is that, while the labeling apparatus improves the efficiency of one step of the order filling process, the remainder of the process must still be completed manually. Specifically, the products in a given customer order must be manually gathered and sorted into the desired customer order before being placed in the product handling apparatus for labeling.

Another problem with some product handling apparatus is that the apparatus can only handle products of one product configuration (products having, for example, the same width, height, length, weight and/or center of gravity) at any one time. To handle products of different product configurations, the apparatus must be stopped and adjusted, if such adjustment is possible, to accommodate the different product configuration, slowing the order filling process.

Yet another problem with some product handling apparatus is that the label is not firmly affixed to the product and may be removed during conveying or by the diverter mechanism when the product is diverted from the conveyor assembly. The product must then be re-labeled, either manually or by being passed through the apparatus a second time.

A further problem with some product handling apparatus is that, if the products are not conveyed in a flat orientation, products can be knocked off of the conveyor belt when a force, such as the force required to apply a label, is applied to the product, and the process will be disrupted. To reduce the likelihood of such an occurrence, the products are thus conveyed in a flat and more stable orientation on the conveyor belt.

Another problem with some product handling apparatus is that, because the products are conveyed in the flat, stable orientation, a significant diverting force must be applied to each product to divert the product from its stable position on the conveyor belt. Such a significant diverting force can normally only be achieved by using a mechanical diverter mechanism which physically engages each product to move the product from the conveyor belt.

One problem with the above-described product handling apparatus including a mechanical diverter mechanism is that, to accommodate the continuous movement of the mechanical diverter mechanism into and out of the product stream, the products can only be conveyed at a relatively slow rate to ensure proper sorting of the products and proper operation of the apparatus. If the products are conveyed at too fast a rate, the mechanical diverter mechanism may disrupt the product stream by engaging products which are not to be diverted to the associated customer order product collection location. As a result, the apparatus can become jammed, stopping the order filling process and requiring operator attention, and products can be damaged.

Another problem with some product handling apparatus is that the diverter mechanism is not controlled to vary the diverting force applied to divert different products. As a result, a product having a different product configuration may not be effectively diverted by the diverter mechanism, disrupting the sorting process.

Yet another problem with some product handling apparatus is that, in the customer order product collection locations, the products are typically jumbled and disorganized. An operator collects the products from the location and must organize and properly arrange the products for packaging and shipment to the customer.

A further problem with some product handling apparatus is that, because of the force applied by the mechanical diverting mechanisms, among other factors, it is difficult to orient the products to be stacked in an organized manner. Further, it is difficult to control movement of the stacked products to provide a consistent stacking surface for subsequent products. Mechanical movement of a product stack to accommodate the following products is awkward to control, and such control becomes increasingly awkward as additional products are loaded onto the product stack. Inconsistent and jerky movement of the product stack results, causing disruption of such a stacking process.

Another problem with some product handling apparatus is that the conveyor assembly includes several independently driven conveyor belts. To effectively transfer products from one conveyor belt to the next, the individual conveyor belts must be synchronized, or the conveying process may be disrupted. Such synchronization requires additional components for sensing and coordinating the movement of the separate and independent conveyor belts.

Yet another problem with some product handling apparatus is that the components of the product handling apparatus are arranged in a relatively straight line along the conveyor assembly. Limited work area space thus limits the number of components, such as customer order product collection locations, which can be included in the product handling apparatus. This limits the number of customer orders which may be processed by the apparatus at any one time. Also, operators of the product handling apparatus must walk the full length of the apparatus, or additional operators are required, to service the widely-spaced components of the apparatus.

The present invention provides a product handling apparatus, components of the product handling apparatus, a method of handling products, and a software program for controlling a product handling apparatus that alleviate the problems with the above-described product handling apparatus and processes. The product handling apparatus of the present invention provides an apparatus and a method for quickly, efficiently and accurately identifying, labeling and sorting products into separate customer orders.

Generally, the product handling apparatus includes an induct area, in which products are inducted or fed, either automatically or manually, into the product handling apparatus, an identification area, in which the product configuration, the product type and the product title are identified, a labeling area, in which product labels are printed, applied to each product and verified, and a product sorting area, in which the products are sorted into the individual customer order product collection locations for packaging and shipment to the customer. A core or main conveyor assembly conveys products from the induct area, through the product handling apparatus, to the product sorting area. A main controller electronically communicates with and controls the components of the product handling apparatus.

In general, products are handled as follows: a wave or group of separate customer orders is bulk collected by operators from locations throughout the warehouse and delivered en masse to the product handling apparatus. The products are then inducted or fed into the product handling apparatus. The products may be automatically fed into the product handling apparatus in a feeder assembly or may be manually fed onto the main conveyor assembly by an operator. The inducted or fed products are then conveyed by a core or main conveyor assembly through the remainder of the product handling apparatus. The products are identified. Corresponding labels are printed, if printing is necessary, and applied to each product. The products are then sorted, and the sorted customer orders are packaged and removed from the product handling apparatus.

One advantage of the present invention is that an apparatus and a method for quickly, efficiently and accurately identifying, labeling and sorting products into separate customer orders are provided, reducing the time and the labor required to complete the order filling process.

Another advantage of the present invention is that the apparatus improves the efficiency of several additional steps in the order filling process.

Yet another advantage of the present invention is that, with minor and automatic adjustments, the product handling apparatus can handle products having different product configurations at one time during one wave of separate customer orders.

A further advantage of the present invention is that the labels are firmly affixed to the product and will not be removed during conveying or by the diverter mechanism.

Another advantage of the present invention is that, while products are conveyed in a less stable, almost upright conveying position, balancing forces are applied to the products to prevent the products from being knocked off of the conveyor belt when a force, such as the force required to apply a label, is applied to the product.

Yet another advantage of the present invention is that, because the products are conveyed in a non-horizontal, almost upright conveying position, a decreased diverting force is required to divert the product from its position on the conveyor belt. Such a decreased diverting force can be achieved by using an air flow provided by an air knife.

A further advantage of the present invention is that, because an air knife diverting mechanism is used, the products can be conveyed at a relatively fast rate. The air knife does not include any mechanical components which enter the product stream and which may disrupt the product stream. As a result, the apparatus is less likely to become jammed and stop the order filling process and, thus, requires less operator attention. Also, products are less likely to be damaged.

Another advantage of the present invention is that the air knife diverter mechanism is controlled to vary the diverting force of the air flow applied to divert different products. As a result, products having different product configurations are effectively diverted by the diverter mechanism.

Yet another advantage of the present invention is that, with stackable products, the products are not jumbled and disorganized in the customer order product collection locations. An operator simply collects the stacked products from the location and packages the stacked products for shipment to the customer.

A further advantage of the present invention is that, because of the controlled force applied by an air knife diverting mechanism, among other factors, the products are more easily oriented for stacking. Further, with the pneumatically-controlled movement of the stack plate, movement of the stacked products is controlled to provide a consistent stacking surface for subsequent products. Pneumatically-controlled movement of a product stack is smooth, and such control remains smooth as additional products are loaded onto the product stack.

Another advantage of the present invention is that the conveyor assembly includes several conveyor belts driven by a common drive motor to provide an "endless" conveyor assembly. The individual conveyor belts are automatically synchronized by this drive arrangement so that products are effectively transferred from one conveyor belt to the next.

Yet another advantage of the present invention is that the components of the product handling apparatus are arranged in parallel sections connected by a turning arrangement. In a limited work area space, the number of components, such as customer order product collection locations, which can be included in the product handling apparatus is effectively increased to almost double, increasing the number of customer orders which may be processed by the apparatus at any one time. Also, operators of the product handling apparatus are not required to walk the full length of the apparatus, and additional operators are not required, to service widely-spaced components of the apparatus.

Other features and advantages of the invention will become apparent to those skilled in the art upon review of the following detailed description, claims and drawings.

DESCRIPTION OF THE DRAWINGS

FIG. 19 is a view looking upstream of an early divert product collection assembly illustrated in FIGS. 1–2.

FIG. 22 is a view of a portion of the product sorting area taken generally along line 22—22 in FIG. 1.

FIG. 24 is a view looking upstream of the stacker assembly illustrated in FIG. 23.

Figure 1:
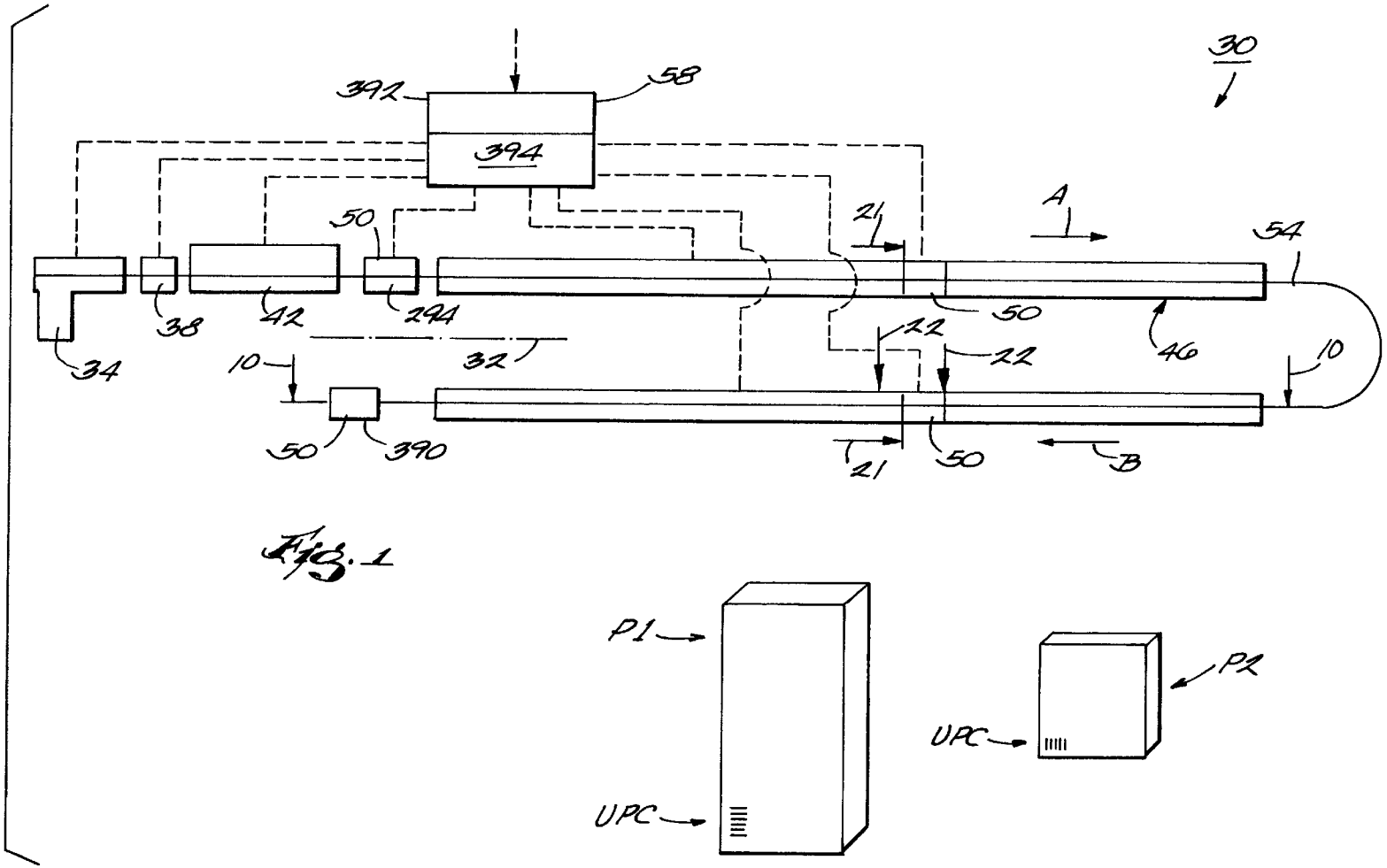
FIG. 1 is a schematic diagram of a product handling apparatus embodying the invention.

Before one embodiment of the invention is explained in detail, it is to be understood that the invention is not limited in its application to the details of the construction and the arrangements of the components set forth in the following description or illustrated in the drawings. The invention is capable of other embodiments and of being practiced or carried out in various ways. Also, it is understood that the phraseology and terminology used herein is for the purpose of description and should not be regarded as limiting.

DETAILED DESCRIPTION OF THE PREFERRED EMBODIMENT

A product handling apparatus 30 embodying the invention is schematically illustrated in FIG. 1. The product handling apparatus 30 is used to identify, label and sort products P. The products P have opposite faces (one shown) and a bottom edge, a top edge, a leading edge and a trailing edge. Each product P typically includes an identifying code, such as an UPC/EAN bar code, which includes information representing the product type and the product title. In the illustrated construction, the products P are music and video products, such as compact discs (CDs), cassette tapes, video cassettes and digital video discs (DVDs). In other constructions (not shown), the products may be other packaged customer products.

A first product P1, having a first product configuration, and a second product P2, having a second product configuration, are illustrated in FIG. 1. To handle the products P1 and P2, the product handling apparatus 30 will require a different machine configuration for each product, as explained below in more detail.

"Product configuration" relates to the physical parameters of a product and includes the length (along the apparatus axis), width (transverse to the apparatus axis), height, weight, center of gravity and surface texture of the product. Products having substantially the same product configuration form a machine configuration. Generally, these products can be diverted and sorted by the product handling apparatus 30 using a common set of divert parameters for the components of the product handling apparatus 30, i.e., the products will be conveyed and diverted in the same manner. Products having different product configurations typically will not be conveyed and will not be diverted in the same manner but will behave in a different manner. Accordingly, different machine configurations are typically required to handle products having different product configurations.

For purposes of discussion, a standard product is a product which can be run through the product handling apparatus 30 because the physical characteristics and the product configuration of the product are accommodated by the product handling apparatus 30. Non-standard products are products which cannot be handled by the product handling apparatus 30 due to the physical limitations of the product handling apparatus 30 and due to the physical characteristics of such products, i.e., oversize, unusual shape and/or poor stacking qualities.

Products are divided into several product categories. A stackable product is a product that can be effectively handled by all components of the product handling apparatus 30. A stackable product is automatically inducted, identified, labeled, diverted and stacked. A non-stackable product is a product which can be inducted, identified, labeled and sorted. However, a non-stackable product cannot be effectively stacked. During sorting, non-stackable products are typically diverted into a product collection location provided by a sort bin for collection of a customer order.

A manually-inducted product is a product that cannot be automatically inducted into the product handling apparatus. An operator manually places the manually-inducted product on the core or main conveyor assembly. A manually-inducted product is then identified, labeled and diverted a product collection location. A conveyable product is a product which can be run on the product handling apparatus 30. Conveyable products include stackable, non-stackable and manually-inducted products.

Finally, a non-conveyable product is a product which cannot be processed by the product handling apparatus 30. Non-conveyable products must be handled manually or by another product handling apparatus capable of accommodating such products. In the illustrated order filling process, the non-conveyable products in a specific customer order are manually gathered, sorted and labeled and are then packaged with the conveyable products of the customer order which are handled by the product handling apparatus 30.

For purposes of discussion, the terms "upstream" and "downstream" are used to identify the relative positions of components of the product handling apparatus 30 relative to the first conveying direction (indicated by arrow A) and the second conveying direction (indicated by arrow B). Also, the term "front" describes a view from an apparatus axis 32 towards either of the conveying directions (arrow A or arrow B). The term "rear" is used to describe a view from outside of the product handling apparatus 30, across either of the conveying directions (arrow A or arrow B), and toward the apparatus axis 32.

Products are bulk picked or gathered from warehouse storage locations as a group of separate customer orders or a wave, and the conveyable products of the wave are processed by the product handling apparatus 30. In general, as shown in FIG. 1, the product handling apparatus 30 includes a product induct area 34, in which products are inducted or fed, either automatically or manually, into the product handling apparatus 30, a product identification area 38, in which the product configuration, the product type and the product title are identified, a product labeling area 42, in which product labels are printed, applied to each product and verified, and a product sorting area 46, in which the products are sorted into the individual customer order product collection locations for packaging and shipment to the customer. The product sorting area includes a plurality of separate product collection locations 50 in which products P are collected. A core or main conveyor assembly 54 conveys products from the product induct area 34, through the other components of the product handling apparatus 30, to the product sorting area 46. A main controller 58 electronically communicates with and controls the components of the product handling apparatus 30.

Figure 2:
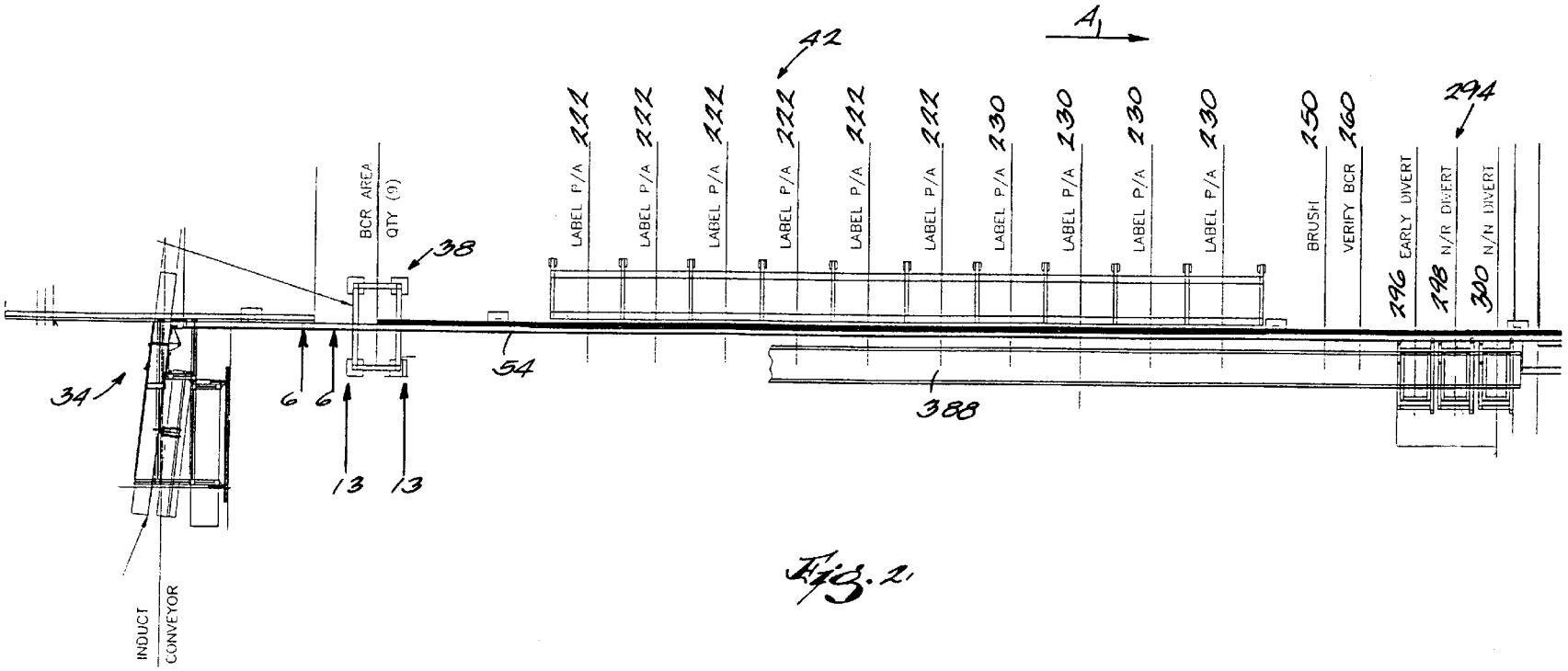
FIG. 2 is a plan view of a portion of the product handling apparatus schematically illustrated in FIG. 1.
Figure 4:
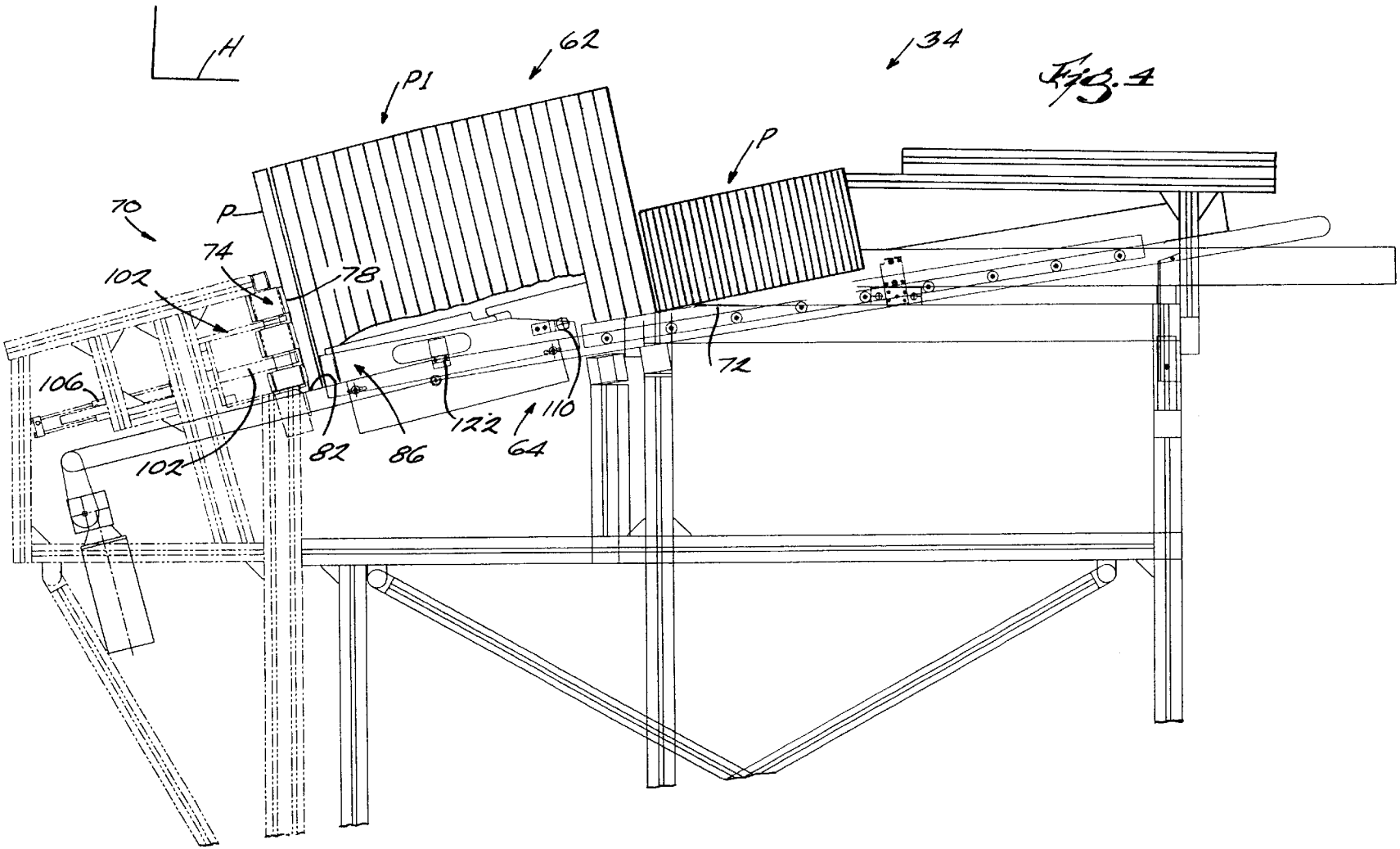
FIG. 4 is a view looking downstream of a feeder assembly illustrated in FIGS. 1–2.
Figure 5:
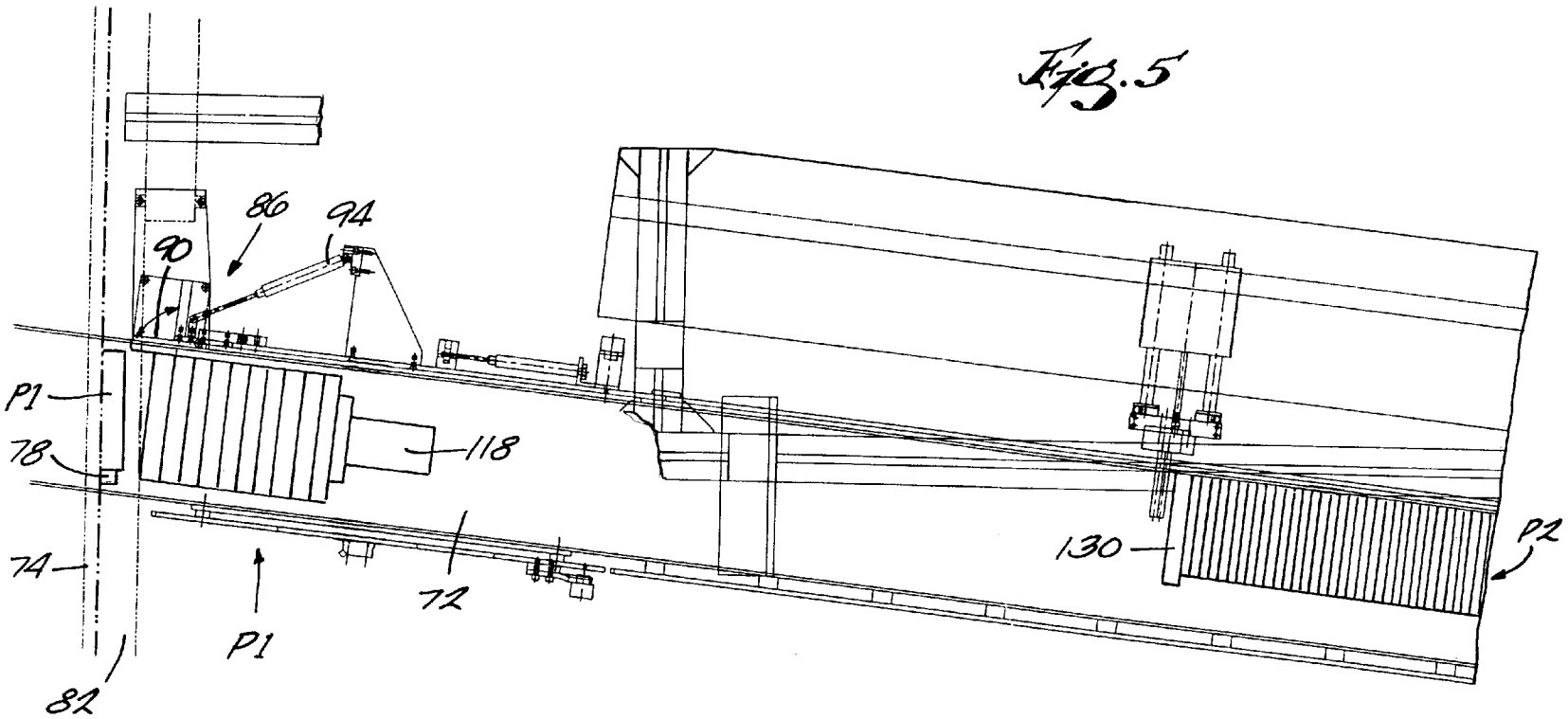
FIG. 5 is a top view of a portion of the feeder assembly illustrated in FIG. 4.
Figure 9:
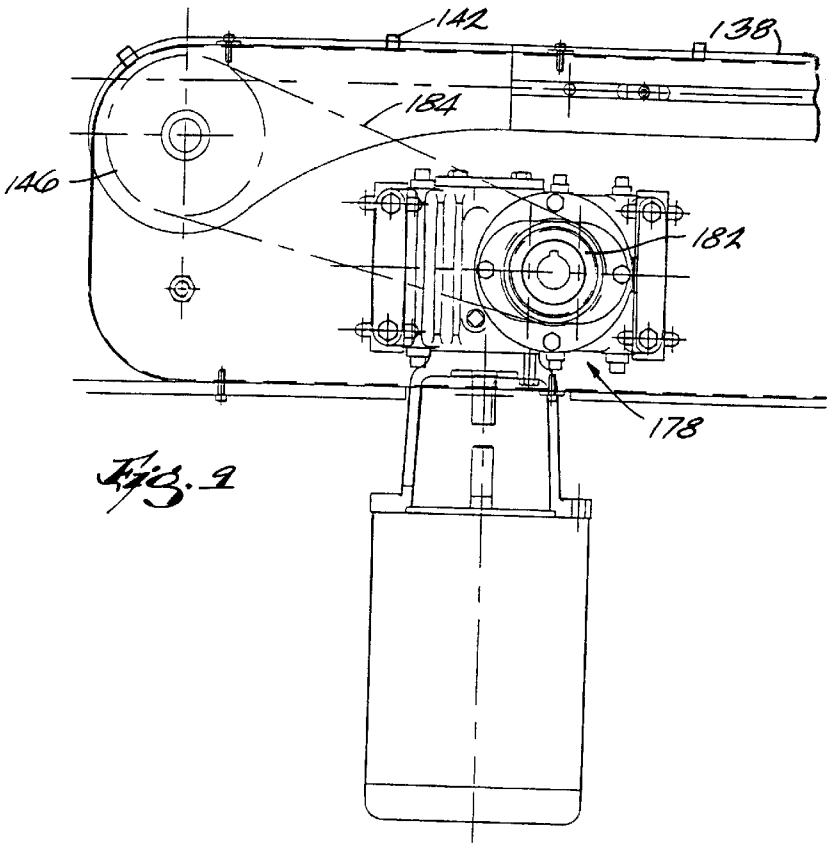
FIG. 9 is a view of the portion of the main conveyor assembly taken generally along line 9—9 in FIG. 7.

As shown in FIGS. 2 and 4–5, the product induct area 34 includes a feeder assembly 62 for feeding products into the product handling apparatus 30. The feeder assembly 62 includes feed conveyor assembly 64 and a strip-off conveyor assembly 70. In the product induct area 34, individual products of varying product configurations are introduced into the product handling apparatus 30. Product rates are determined in the product induct area 34 and, for example, may be set at 100, 200 or 300 products per minute (ppm).

The feed conveyor assembly 64 includes a feed conveyor belt 72 which is a powered belt conveyor and which generally slopes downwardly at approximately 15° towards a strip-off conveyor assembly 70. The operator stages the products P in a feed stack on the feed conveyor belt 72. The feed stack has a forward end, adjacent the strip-off conveyor assembly 70, and a rearward end, on which additional products may be staged. The products are positioned in the feed stack in face-to-face relation and are supported on their respective bottom edges by the feed conveyor belt 72.

Preferably, the products P are oriented in the feed stack to ensure proper labeling of the products in the product labeling area 42. Also, the products P are preferably staged by product configuration for proper sorting and stacking in the product sorting area 46, as explained below in more detail. In addition, the products P are preferably inducted in sets having the same product configuration so that a single machine configuration can be used at one time. However, the main controller 58 is capable of controlling the components of the product handling apparatus 30 to allow products of various product configurations to be inducted and handled by the product handling apparatus 30.

The strip-off conveyor assembly 70 includes a strip-off conveyor belt 74 which is a dual, cleated conveyor belt and which is oriented non-horizontally and, preferably, almost vertically. The strip-off conveyor belt 74 includes a belt surface and a plurality of cleat members 78 spaced apart along the apparatus axis 32 and extending from the belt surface. The strip-off conveyor assembly 70 also includes a lower support member 82 having a smooth, low-friction support surface.

To strip a product from the feed conveyor assembly 64, the product P at the forward end of the feed stack moves into the strip-off area. The lower support member 82 engages the bottom edge of the product P to support the product P, and the belt surface of the strip-off conveyor belt 74 engages one face of the product P. A cleat member 78 engages the trailing edge of a product P to strip the product P from the feed stack. The cleat member 78 engages the product P at a height and a distance from the bottom edge sufficient to prevent the product P from tipping in an upstream direction. The strip-off conveyor assembly 70 supports the product P in a conveying position in which the one face of the product P is in a non-horizontal, almost upright orientation and, preferably, is angled at least 70° from a horizontal plane H (shown in FIG. 4).

The feeder assembly 62 also includes (see FIG. 5) a back pressure assembly 86 which ensures that only one product at a time is stripped from the forward end of the feed stack. The back pressure assembly 86 is adjustable to allow products of different widths (such as product P1 and P2) to be fed into the product handling apparatus 30. The back pressure assembly 86 includes a back pressure door 90 which is movably supported by a biasing mechanism, such as a cylinder assembly 94. The back pressure door 90 engages the leading edge of the following products in the feed stack to ensure that only one product at a time is stripped from the feed stack.

The cylinder assembly 94 allows the back pressure door 90 to apply a back pressure on the products in the feed stack. The cylinder assembly 94 also allows the back pressure door 90 to be positioned relative to the strip-off conveyor assembly 70 to define a space which is less than the width of more than one product. The back pressure door 90 may be positioned in a first position, defining a space less than the width of more than one first product P1 (as shown in FIG. 5), and a second position, defining a space less than the width of more than one second product P2.

The feeder assembly 62 also includes (see FIG. 4) an induct stop or hold-off assembly 98 to hold the products P in the feed stack in spaced relation from the strip-off conveyor assembly 70 to prevent products P from being inducted. The hold-off assembly 98 includes a hold-off plate 102 which is supported for movement between a hold-off position, in which products are prevented from being inducted, and an induct position (shown in FIG. 4), in which products may be inducted. Preferably, the hold-off plate 102 is pneumatically operated and is movably supported by a cylinder assembly 106. An activation switch (not shown) operates the hold-off assembly 98.

The feeder assembly 62 also includes (see FIG. 4) a low-level detecting mechanism, such as a photo eye 110 and receptor (not shown). When sufficient products are staged in the feed stack (as shown in FIG. 4), the eye 110 is blocked. When the number of products in the feed stack reaches a low level, the eye 110 is unblocked, and a low-level indicator (not shown) indicates that a low-level of products has been reached. In the illustrated construction, the hold-off plate 102 then automatically extends to the hold-off position to engage the products in the feed stack and to stop induction of products. Once the operator has staged sufficient products P, the operator activates the switch, and the hold-off plate 102 moves to the induct position to allow induction of products P.

If, as shown in FIG. 5, the operator is at the end of a wave session and wants to induct the last remaining products in the wave, an induct assist block 118 is used. The induct assist block 118 engages the trailing products at the rearward end of the feed stack to assist in the smooth induction of a short stack of products. The induct assist block 118 triggers (see FIG. 4) a low-level proximity switch 122 (which serves the same purpose as the eye 110 and receptor) and assists the products onto the strip-off conveyor assembly 70. However, the induct assist block 118 does not enter the strip-off area. When the last product in the feed stack is inducted and the feed conveyor belt 72 is empty, the hold-off plate 102 is again extended to the hold-off position.

The hold-off plate 102 also moves to the hold-off position if a blockage occurs in the product handling apparatus 30. This ensures that additional products will not be fed into the obstructed portion of the product handling apparatus 30.

The feeder assembly 62 also includes (see FIG. 5) a feed stack stop 130 behind which products can be staged. The operator can stage products from a subsequent wave behind the feed stack stop 130 while the remaining products in a first wave are inducted.

In operation, the operator stages products P1 (and/or P2) on the feed conveyor belt 72 in the feed stack. When a sufficient number of products P1 are staged, the hold-off plate 102 is moved to the induct position so that products P1 can be inducted. The product P1 at the forward end of the feed stack moves into the strip-off area. The one face of the product P1 engages the belt surface of the strip-off conveyor belt 74, and the bottom edge of the product P1 engages the lower support member 82 so that the product P1 is supported. A cleat member 78 engages the trailing edge of the product P1 to strip the product P1 from the feed stack and convey the product to the main conveyor assembly 54. The back pressure door 90 applies a back pressure to the leading edge of the remaining products in the feed stack to ensure that only one product P1 is stripped-off at a time.

When products of a different product configuration, such as the second products P2, are to be inducted into the product handling apparatus 30, the back pressure door 90 is adjusted to the second position (not shown). In the second position, the back pressure door 90 allows the second products P2 to be stripped-off but ensures that only one second product P2 at a time is stripped from the feed stack.

Products on the strip-off conveyor belt 74 are transferred to the main conveyor assembly 54. As shown in FIGS. 2–3 and 6–12, the main conveyor assembly 54 includes a plurality of conveyor belts which run from the product induct area 34 through the remainder of the product handling apparatus 30. The main conveyor assembly 54 provides an "endless" conveyor assembly of separate conveyor belts which are synchronized.

Figure 6:
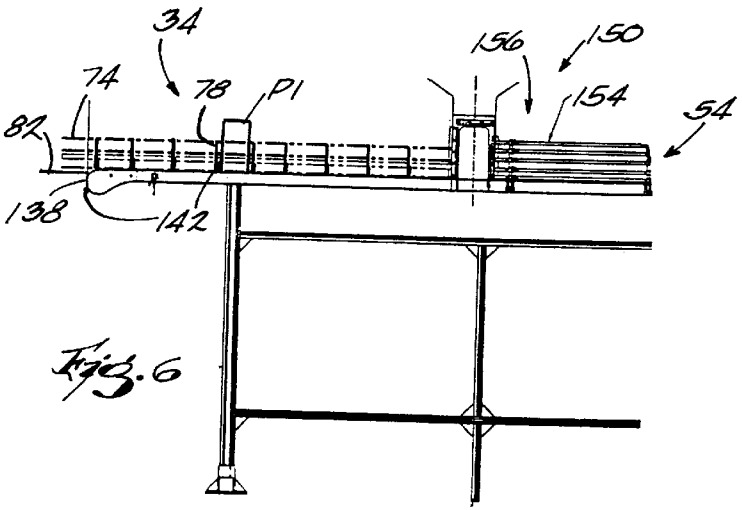
FIG. 6 is a view of a portion of the feeder assembly and a portion of a main conveyor assembly taken generally along line 6—6 in FIG. 2.

As shown in FIG. 6, a first conveyor belt 138 is supported adjacent the downstream end of the strip-off conveyor belt 74 and includes a belt surface and a plurality of first cleat members 142 spaced apart along the apparatus axis 32 and extending from the belt surface. A first drive sprocket 146 drivingly engages the first conveyor belt 138.

The main conveyor assembly 54 also includes a product guide and support assembly 150. The product guide and support assembly 150 includes a first support member 154 associated with the first conveyor belt 138. The first support member 154 extends substantially parallel to the first conveyor belt 138 and has a smooth, low friction first support surface.

As shown in FIG. 6, the belt surface of the first conveyor belt 138 is substantially coplanar with the support surface of the lower support member 82 of the strip-off conveyor assembly 70 and is engageable with the bottom edge of the product to support the product. Similarly, the support surface of the first support member 154 is substantially coplanar with the belt surface of the strip-off conveyor belt 74 and is engageable with the one face of the product P to support the product P in the non-horizontal, almost upright conveying position.

The strip-off conveyor belt 74 and the first conveyor belt 138 are synchronized so that a product P is smoothly transferred from the product induct area 34 to the main conveyor assembly 54. As the cleat member 78 conveys the product downstream onto the first conveyor belt 138, a first cleat member 142 engages the trailing edge, proximate the bottom edge, to continue conveying the product downstream. Such synchronization ensures that the product does not slow down when disengaged by the cleat member 78 and tip in the upstream direction when engaged by the first cleat member 142 and, thereby, reduces the likelihood that the product handling apparatus 30 will become blocked.

As shown in FIG. 6, a manual induct area 156 is provided adjacent the strip-off conveyor assembly 70 and is used for manually-inducted products. The manual induct area 154 is provided by an open section of the first conveyor belt 138 after the automatic induct area, provided by the feeder assembly 62, and before the product identification area 38. In the manual induct area 156, the operator carefully places a product onto the first conveyor belt 138 between cleat members 142. During induct, the operator can manually induct any manually-inducted products (not shown) in the manual induct area 134 so that all conveyable products are inducted into the product handling apparatus 30.

The main conveyor assembly 54 also includes (see FIG. 7) a second conveyor belt 158 positioned downstream to receive products from the first conveyor belt 138. The second conveyor belt 158 has a belt surface and a plurality of second cleat members 162 spaced apart along the apparatus axis 32 and extending from the belt surface. A second drive sprocket 166 drivingly engages the second conveyor belt 158.

Figure 7:
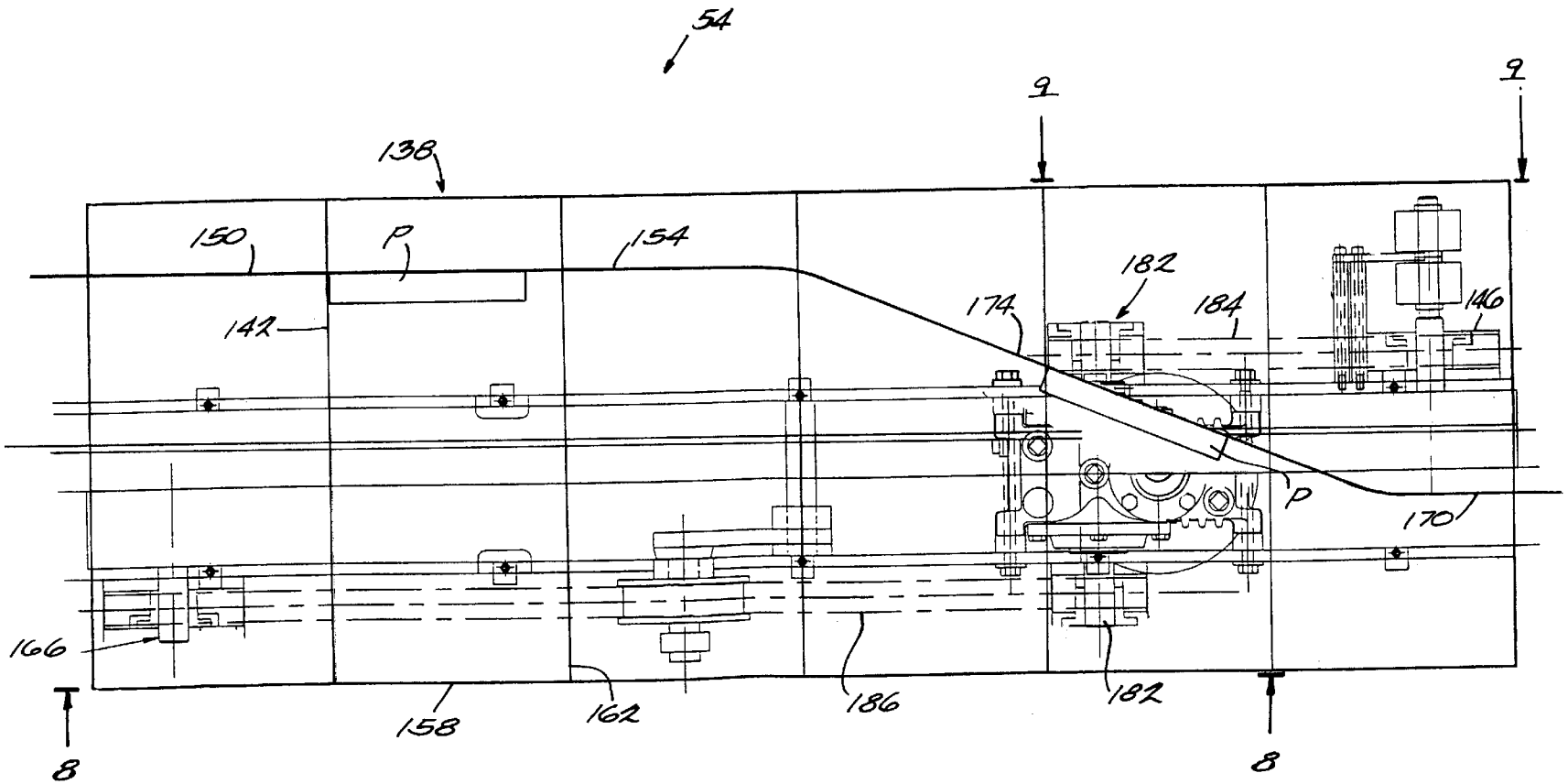
FIG. 7 is a top view of a portion of the main conveyor assembly.
Figure 8:
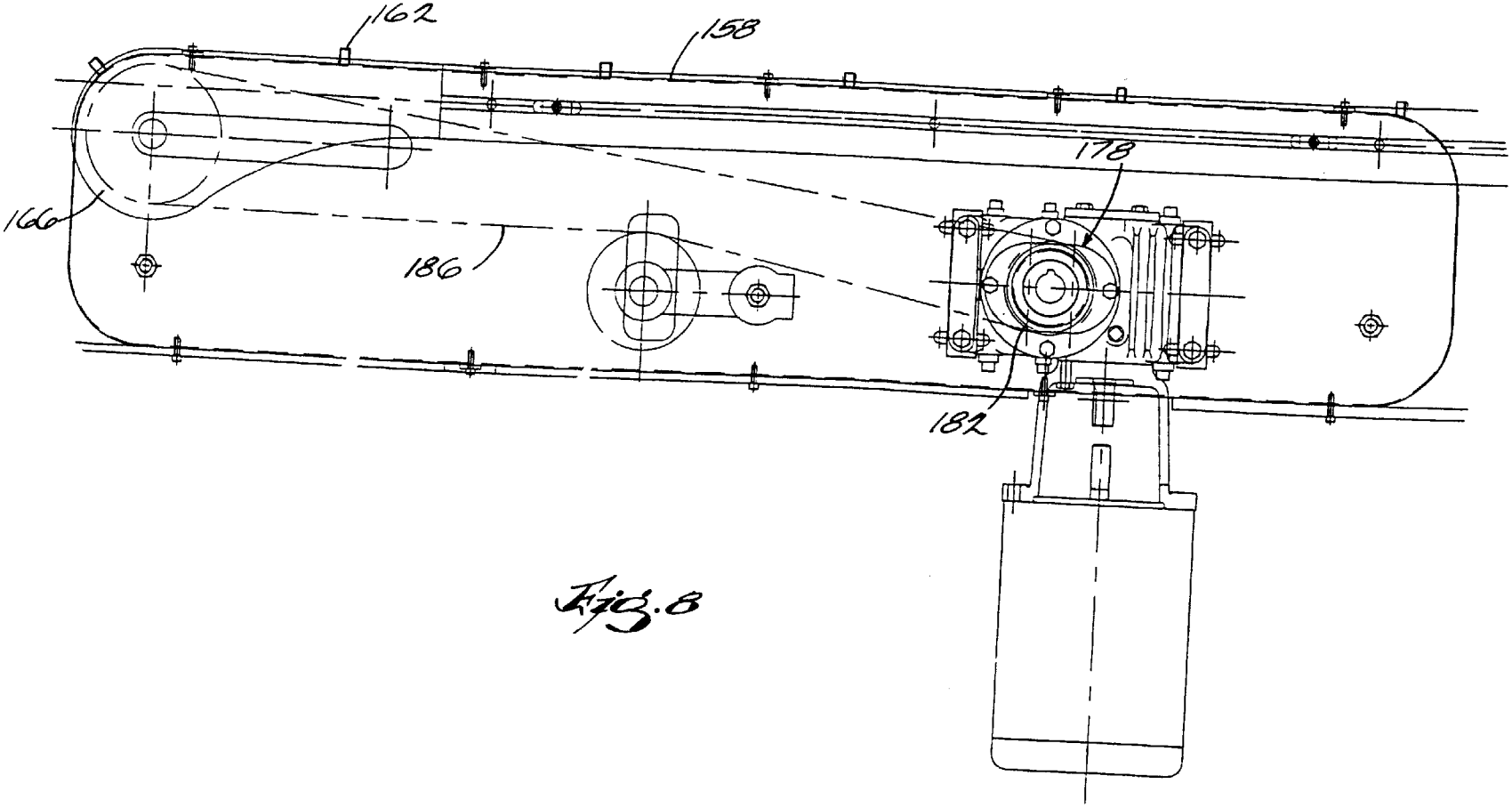
FIG. 8 is a view of the portion of the main conveyor assembly taken generally along line 8—8 in FIG. 7.
Figure 11:
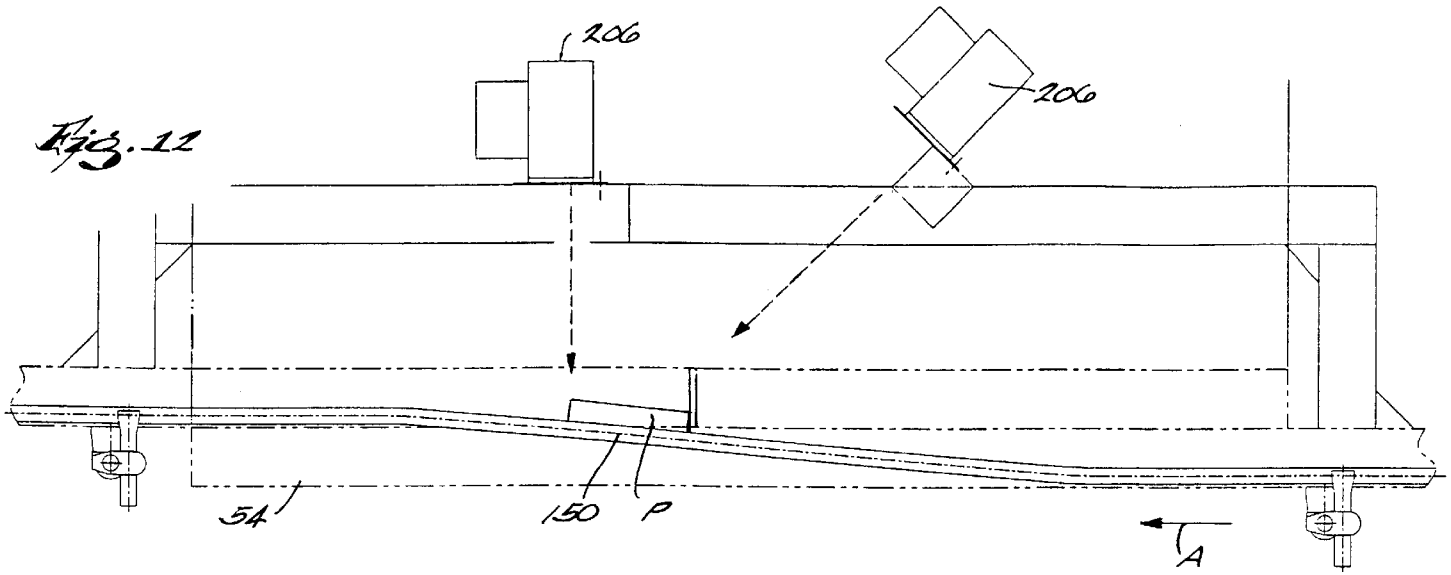
FIG. 11 is a top view of another portion of the main conveyor assembly.
Figure 10:
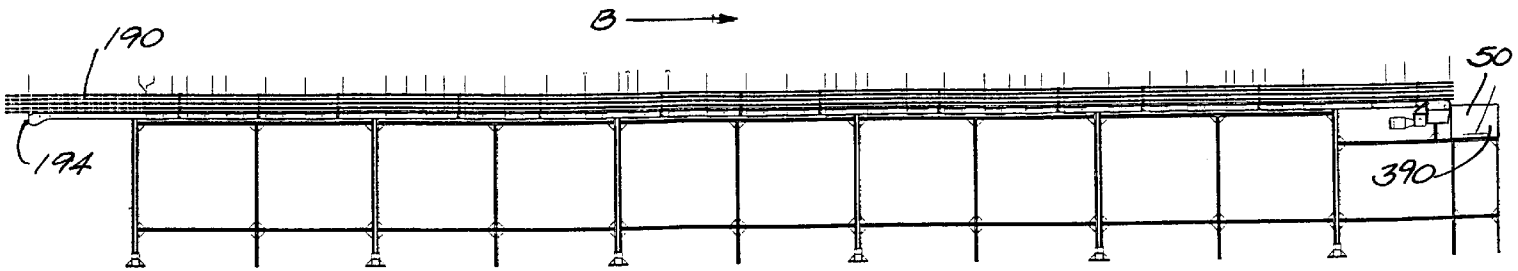
FIG. 10 is a view of another portion of the main conveyor assembly taken generally along line 10—10 in FIG. 3.
Figure 12:
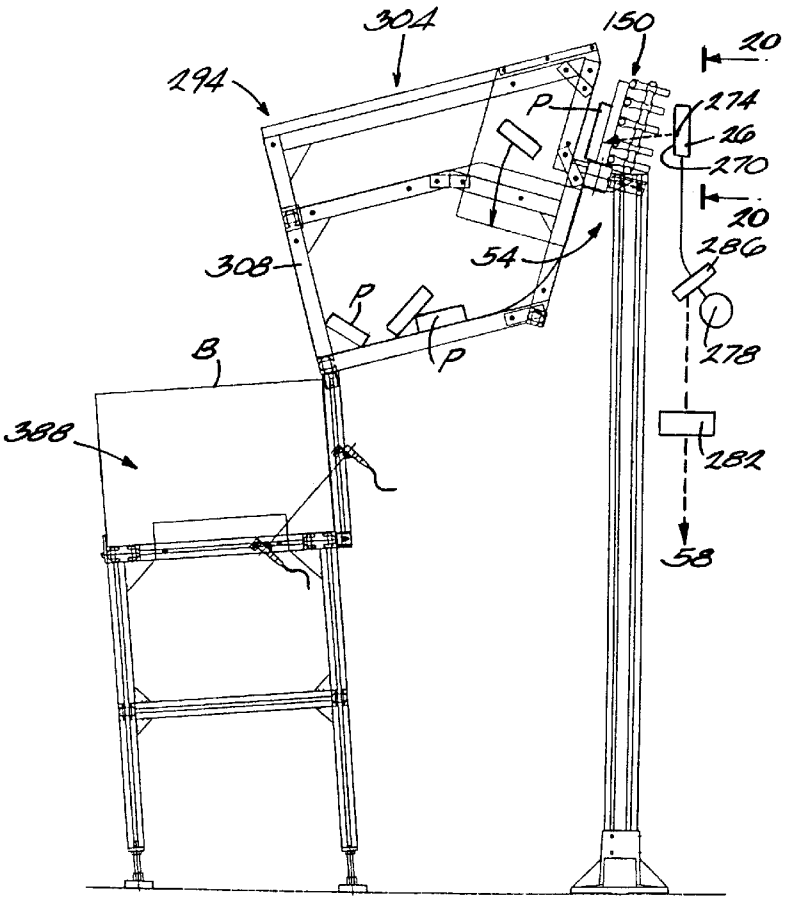
FIG. 12 is an enlarged view of a portion of the main conveyor assembly illustrated in FIG. 11.
Figure 11:
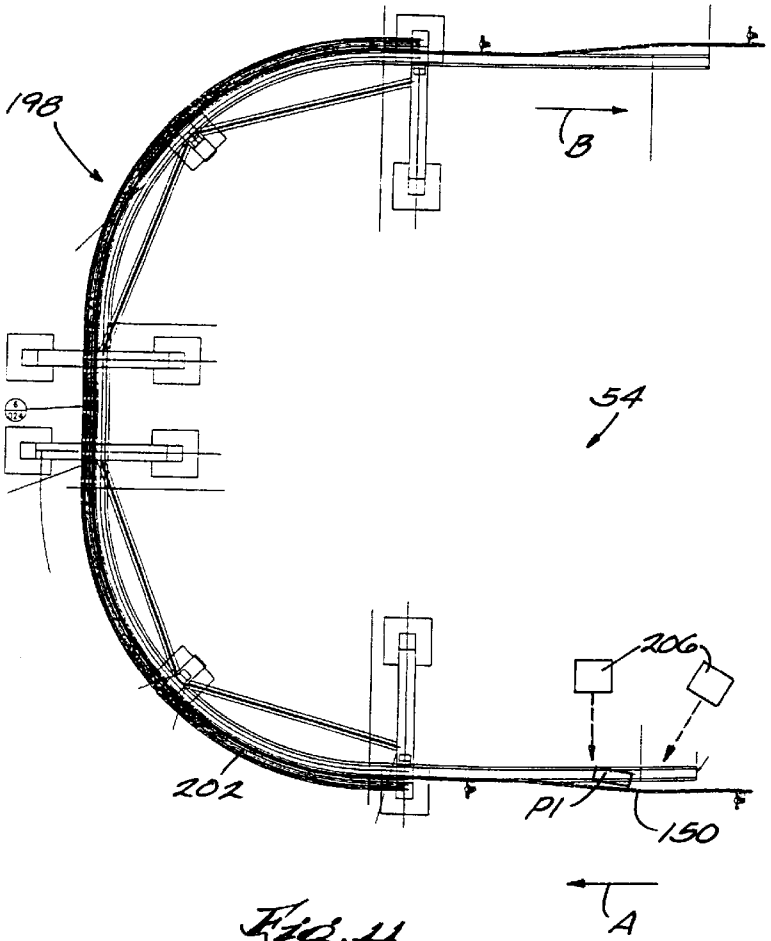

The product guide and support assembly 150 also includes a second support member 170 associated with the second conveyor belt 158. The second support member 170 extends substantially parallel to the second conveyor belt 158 and has a smooth, low friction support surface. As shown in FIG. 7, the first conveyor belt 138 and the second conveyor belt 158 are laterally offset. The product guide and support assembly 150 also includes a transfer guide member 174 having a smooth, low friction guide surface which is engageable with the one face of the product P to guide the product P from the first conveyor belt 138 to the second conveyor belt 158.

The main conveyor assembly 54 supports and conveys products through the product handling apparatus 30 in the non-horizontal, almost upright conveying position. Preferably, the products are supported so that the one face engaged by the product guide and support assembly 150 is angled at least 70° from a horizontal plane.

The main conveyor assembly 54 also includes a drive motor 178 having a rotatable drive shaft 182 drivingly engaging the first drive sprocket 146, through a first drive chain 184, and drivingly engaging the second drive sprocket 166, through a second drive chain 186. During assembly of the main conveyor assembly 54, the first conveyor belt 138 and the second conveyor belt 158 are synchronized so that a product is transferred smoothly from the first conveyor belt 138 to the second conveyor belt 158. As the product is transferred, a second cleat member 162 engages the trailing edge of the product P to continue to convey the product P downstream. The second support surface member 170 engages the one face of the product P to support the product P in the non-horizontal conveying position.

Because the first conveyor belt 138 and the second conveyor belt 158 are initially synchronized, and because the first conveyor belt 138 and the second conveyor belt 158 are driven by a common drive motor 178, the first conveyor belt 138 and the second conveyor belt 158 are automatically synchronized and remain synchronized during operation of the main conveyor assembly 54. Subsequent conveyor belts of the main conveyor assembly 54 are driven and synchronized in a similar manner.

As shown in FIG. 1, a first portion of the main conveyor assembly 54 conveys products in a first conveying direction (indicated by arrow A), and a second conveyor portion conveys products in a second conveying direction (indicated by arrow B) opposite to the first conveying direction. The second conveyor portion includes (see FIG. 10) a third conveyor belt 190 having a belt surface and a plurality of third cleat members 194 spaced apart along the apparatus axis 32 and extending from the belt surface.

To direct products from the first conveying direction to the second conveying direction, the main conveyor assembly 54 includes (see FIG. 11) a turning guide assembly 198 supported to receive products from the first conveying portion in the first conveying direction and to transfer the products to the second conveyor portion in the second conveying direction. The turning guide assembly 198 provides a 180° turn in the main conveyor assembly 54. The turning guide assembly 198 includes a curved guide member 202 having a smooth, low friction support surface engaging the one face of the product to support the product in the non-horizontal, almost upright conveying position.

Due to the momentum of the products being transferred from the first conveying portion to the turning guide assembly 198, some products may have a tendency to "jump" from the main conveyor assembly 54 as these products approach the turning guide assembly 198. To prevent the products from leaving the main conveyor assembly 54, at least one and, in the construction illustrated in FIGS. 11–12, two air knife assemblies 206 are supported proximate the junction between the first conveying portion and turning guide assembly 198. The air knife assemblies 206 provide an air flow to maintain the products on the main conveyor assembly 54 and to guide the products from the first conveying portion and onto the turning guide assembly 198.

The turning guide assembly 198 and the 180° turn allow additional components, such as sort destinations or product collection locations to be included in the product handling apparatus 30 in the limited work area space. Also, operators are not required to walk the full length of the product handling apparatus to service the components of the product handling apparatus 30.

Figure 13:
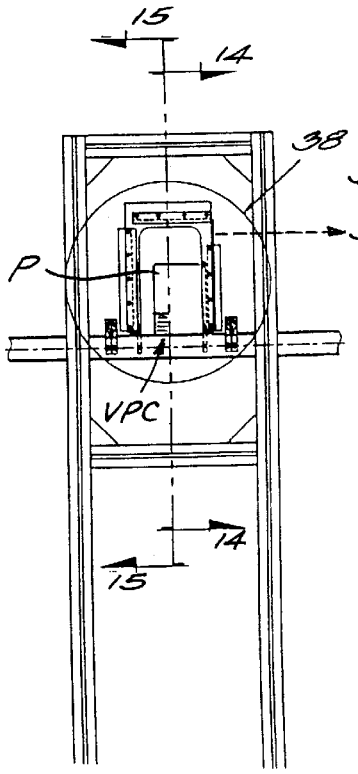
FIG. 13 is a view of a product identification area taken generally along line 13—13 in FIG. 2.
Figure 14:
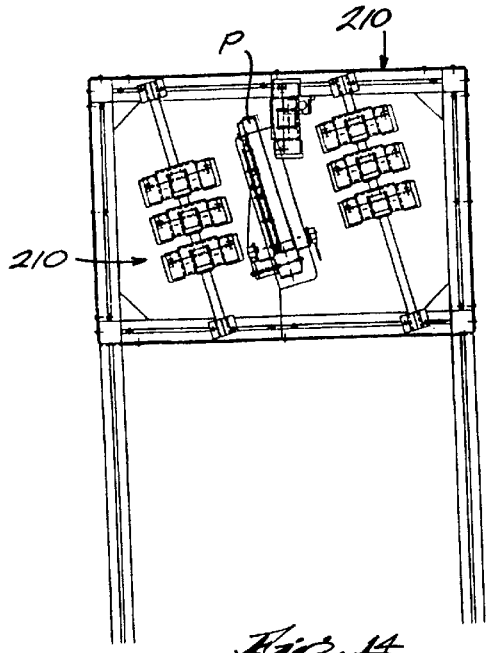
FIG. 14 is a view of the product identification area taken generally along line 14—14 in FIG. 13.
Figure 15:
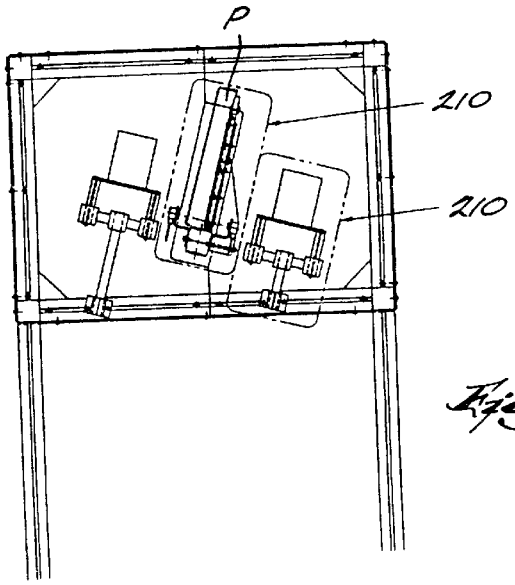
FIG. 15 is a view of the product identification area taken generally along line 15—15 in FIG. 13.

As shown in FIG. 2, after receiving products from the product induct area 34, the main conveyor assembly 54 conveys the products through the product identification area 38. The product identification area 38 includes (see FIGS. 13–15) an array of bar code readers 210 to read the UPC/EAN bar code on each product P. The array of bar code readers 210 is constructed so that the opposite faces, the top edge, the leading edge and the trailing edge of each product P can be examined.

The array of bar code readers 210 reads the bar code on the product and outputs an identification signal, corresponding to the information in the bar code, to the main controller 58. The identification signal represents the information identifying the product configuration, the product type and the product title. The main controller 58 compares the information in the identification signal to the stored information representing the customer orders and, based on the identification signal, outputs signals to the components of the product handling apparatus 30 corresponding to the information in the identification signal. If the array of bar code readers 210 is not able to identify a product, the array of bar code readers 210 will output a no-read identification signal to the main controller so that the main controller 58 can cause the no-read product to be diverted into a no-read product collection location 50, as explained below in more detail.

Figure 16:
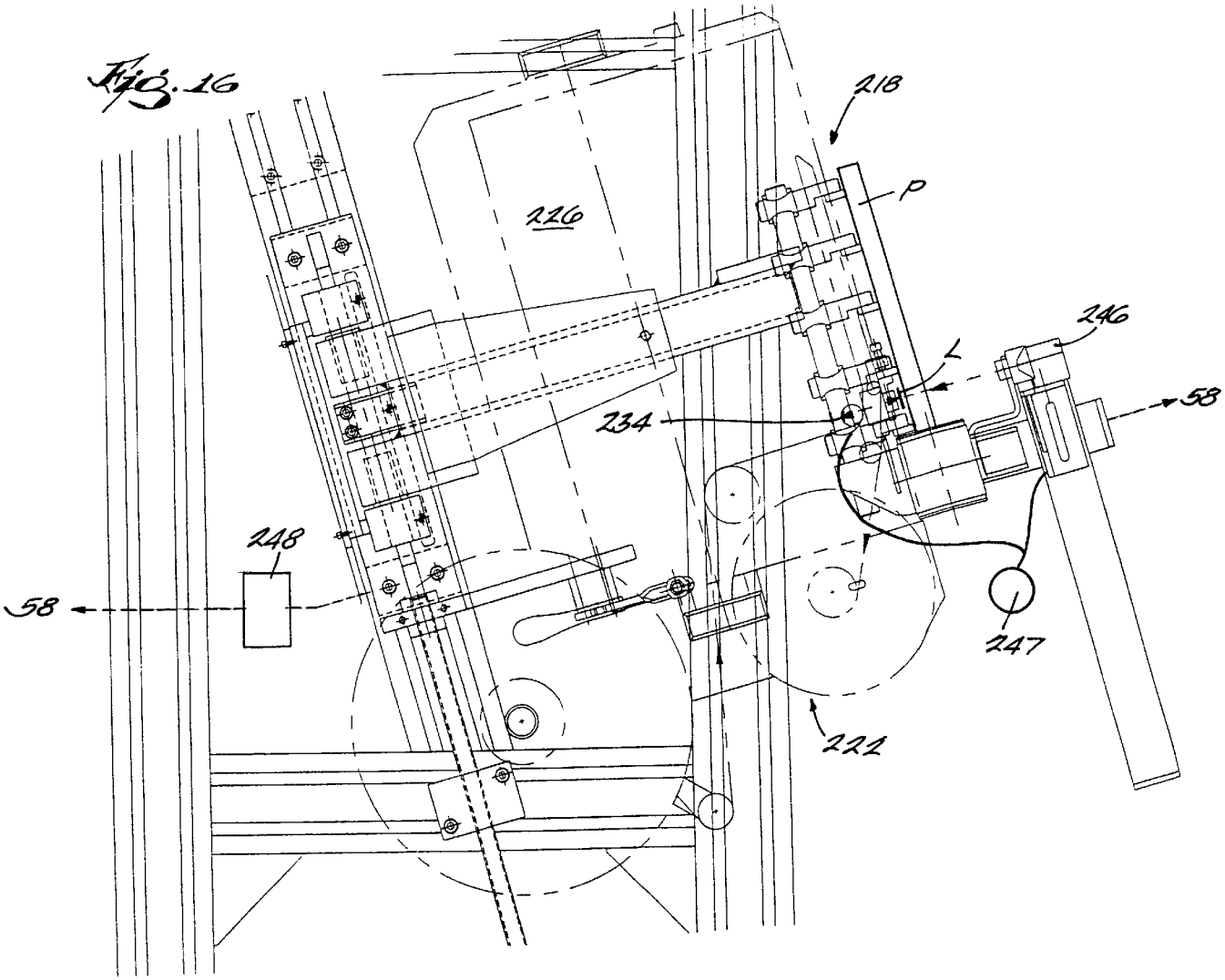
FIG. 16 is a view looking downstream of a labeler assembly of a product labeling area illustrated in FIGS. 1–2.

After product identification, the main conveyor assembly 54 then conveys the products to the product labeling area 42 and continuously conveys the products through the product labeling area 42. As shown in FIG. 2, the product labeling area 42 includes a plurality of and, in the illustrated construction, ten labeler assemblies 218 for applying a label to a product. Six of the labeler assemblies 218 are printer/labeler assemblies 222 including (see FIG. 16) a printer 226, for printing specific information on a label L, and four of the labeler assemblies 218 are checkpoint labeler assemblies 230 which apply checkpoint-type labels. The printer/labeler assemblies 222 and the checkpoint labeler assemblies 230 include (see FIG. 16) a label applicator, such as an air knife 234, which provides an application air flow having an application force and duration to apply the label L to the one face of the product P.

To balance the application force applied by the label applicators, each labeler assembly 218 also includes a balancing force applicator, such as a balancing air knife 246, which provides a balancing air flow having a balancing force and duration to the other face of the product to balance the application force and to maintain the product on the main conveyor assembly 54. Preferably, the application force and the balancing force are applied for a substantially equal duration. To do so, the application air knife 234 and the balancing air knife 246 are preferably supplied simultaneously from the same air supply 247 through a control valve (not shown).

Each labeler assembly 218 includes a label controller 248 communicating with the main controller 58 to control printing of a label, if required, and application of the label to the product. Label information is stored in the product wave information in the main controller 58. The main controller 58 conducts a look-up for each product based on the identification signal for that product, and specific label information for that product is accessed. The main controller 58 outputs a label control signal corresponding to the specific label information to the label controller 248 for the appropriate labeler assembly 218. The label controller 248 then controls the associated labeler assembly 218 to correctly label the corresponding product.

Figure 18:
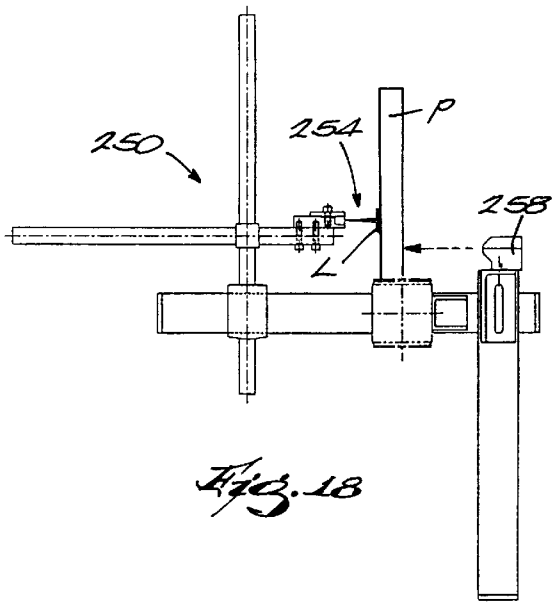
FIG. 18 is a view of a portion of the product labeling area taken generally along line 18—18 in FIG. 17.

The product labeling area also includes (see FIGS. 17–18) an iron-on/brush-on assembly 250 to firmly affix the label L to the product P. The iron-on/brush-on assembly 250 includes a pressure applicator, such as a resilient brush 254, which extends into the product stream. The iron-on/brush-on assembly 250 also includes a second balancing force applicator, such as a second balancing air knife 258, to apply a second balancing air flow having a second balancing force and duration to the other face of the product to press the product and the label against the brush 254 as the product is conveyed downstream and to maintain the product on the main conveyor assembly 54. The pressure applicator 254 thus provides a fixing pressure to firmly affix the label on the product.

Figure 17:
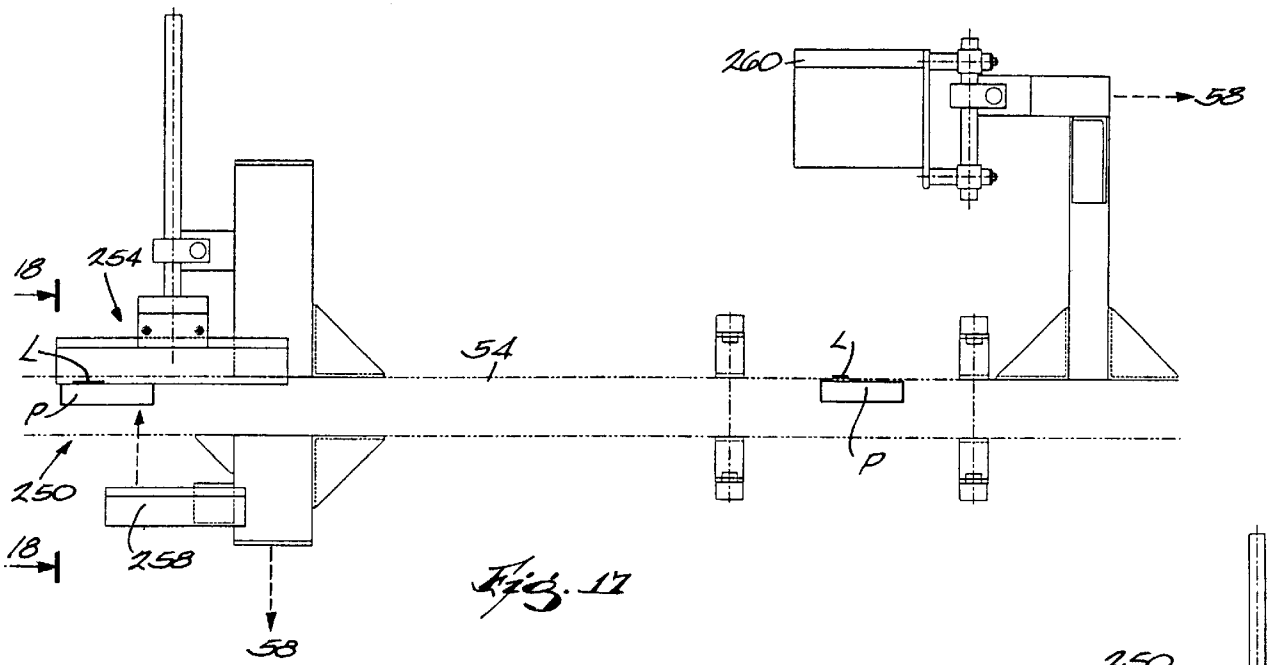
FIG. 17 is a top view of a portion of the product labeling area illustrated in FIGS. 1–2.
Figure 20:
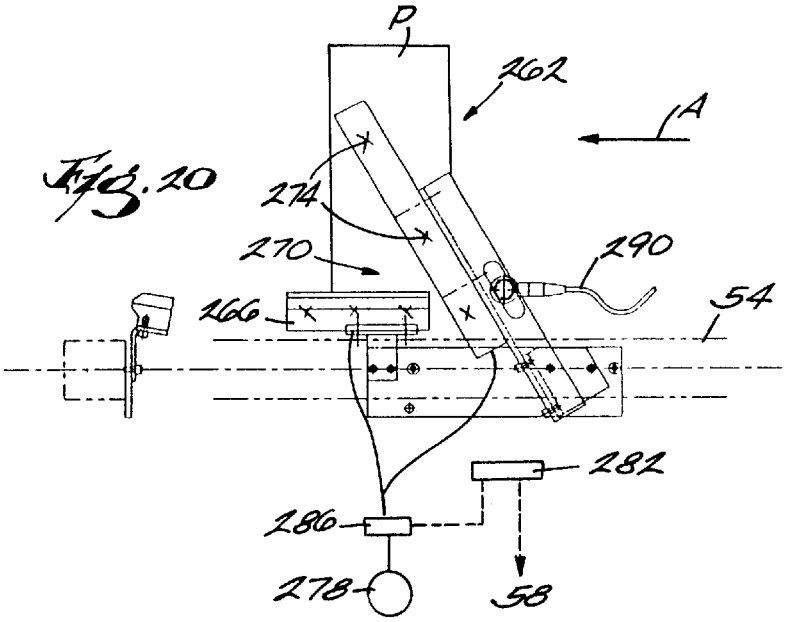
FIG. 20 is a view of a diverter assembly taken generally along line 20—20 in FIG. 19.

As shown in FIG. 17, a label verification scanner or bar code reader 260 is positioned downstream of the labeler assemblies 218 and the iron-on/brush-on assembly 250. The bar code reader 260 verifies that the proper label was properly affixed to the product. If there is an error, the bar code reader 214 outputs a label error signal to the main controller 58 which, in turn, will cause the mislabeled product to be diverted into a non-customer product collection location 50.

Figure 3:
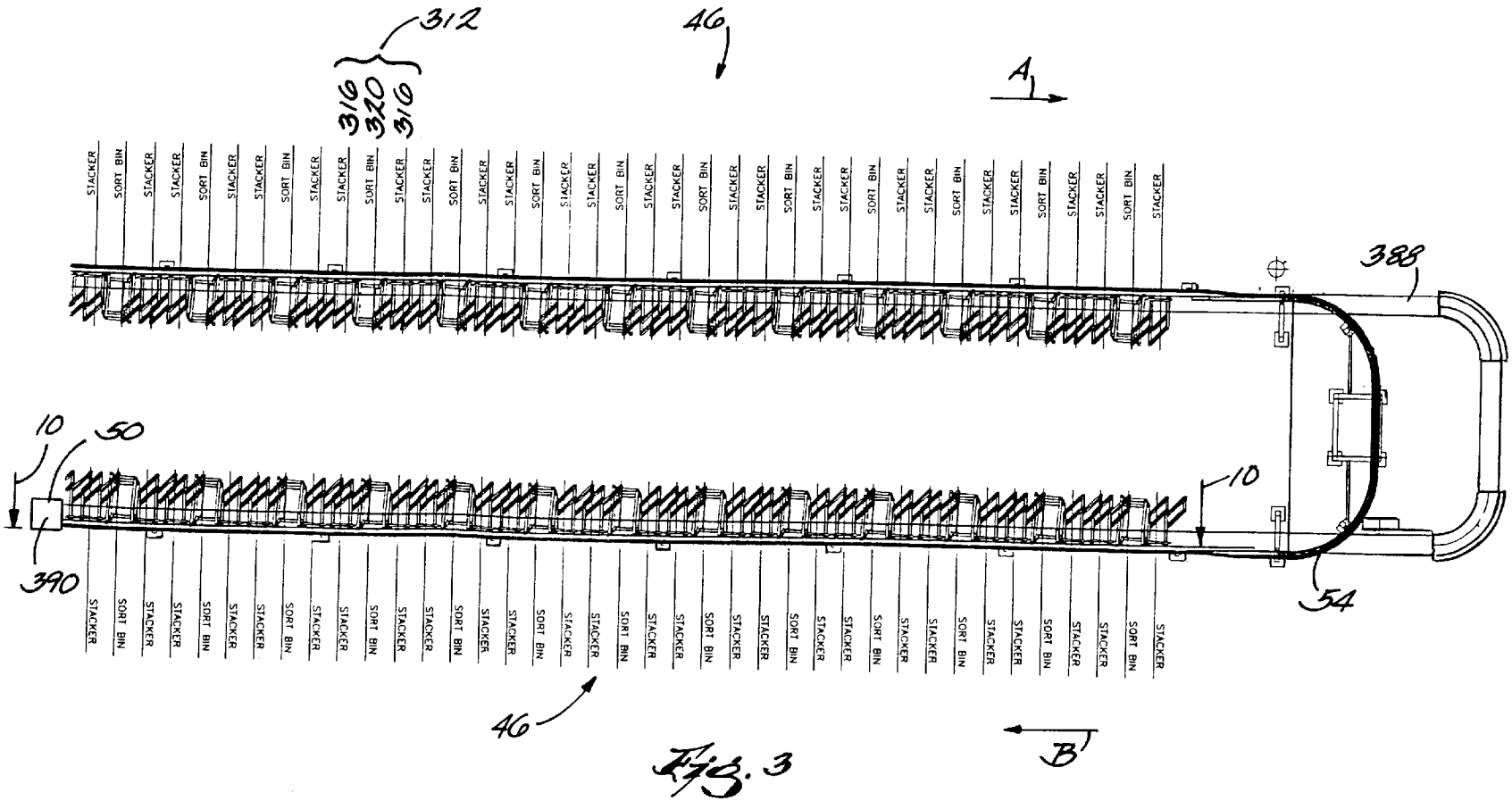
FIG. 3 is a plan view of another portion of the product handling apparatus schematically illustrated in FIG. 1.

As shown in FIGS. 1 and 3, the main conveyor assembly 54 then conveys the products to the product sorting area 46 so that the products can be diverted into and collected in product collection locations 50. These product collection locations 50 may correspond to a non-customer location, such as a no-read or no-need divert location, or to a customer order location into which products are sorted. However, a majority of the product collection locations 50 are customer order product collection locations.

As shown in FIGS. 19–24, each product collection location 50 includes an associated diverter assembly 262 for selectively diverting products from the main conveyor assembly 54 into the product collection location 50. As shown in more detail in FIGS. 19–20, the diverter assembly 262 includes a diverter mechanism 266 including an air knife 270 which selectively produces a divert air flow against the one face of the product P to divert the product P from the main conveyor assembly 54 and into the product collection location 50. The air knife 270 includes a plurality of nozzles 274 communicating with an air supply 278 (schematically illustrated). The air knife 270 is a pneumatic device and uses a blast of air, the divert air flow, to guide or divert a product from the main conveyor assembly 54.

The diverter assembly 262 also includes a diverter controller 282 communicating with the main controller 58. The diverter controller 282 controls a valve 286 to control the air knife 270. A photo eye 290 signals the diverter controller 282 when the product to be diverted approaches the diverter area.

The diverter controller 282 controls the air knife 270 to selectively produce an air flow against the one face of the product to divert the product. The diverter controller 282 controls the air knife 270 so that the air flow is variable and controllable to provide a different air flow for different product configurations. In the illustrated construction, the diverter controller 282 controls the valve 286 to select the amount of air that will be supplied through the nozzles 274 to provide the selected air flow. In other constructions (not shown), the diverter controller 282 may vary the air flow by, for example, selecting the nozzles 274 through which air is supplied or varying the size of the nozzles 274.

When a product P is to be diverted into the associated product collection location 50, the main controller 58 outputs a divert signal to the diverter controller 282. As the designated product P approaches the diverter assembly 262, the photo eye 290 senses the product P and outputs a position signal to the diverter controller 282 to indicate that the product P is approaching the diverter area. At the proper time, the diverter controller 282 controls the valve 286 to provide the divert air flow through the air knife 270 to divert the designated product P into the associated product collection location 50.

The diverter controller 282 also controls the diverter assembly 262 to not provide the divert air flow so that a non-designated product is not diverted into the associated product collection location 50. The non-designated product can thus pass the associated product collection location 50 so that the product can be diverted into a subsequent product collection location 50 to which that product is designated.

The air flow is selected based on the information provided in the divert signal output by the main controller 58. To divert a first product P1, the air knife 270 is controlled to produce a first air flow, and to divert a second product P2, the air knife 270 is controlled to produce a second air flow. Because the air flow from the air knife 270 is controlled and variable, the air knife 270 can effectively divert products having different product configurations.

The length, timing and force of the air blast or divert air flow required to divert a product into a product collection location 50 is determined by the product configuration. The main controller 58 and the diverter controller 282 cooperate to control the diverter assembly 262 to divert a given product having a given product configuration.

Because the products are conveyed in a non-horizontal and, preferably, almost upright conveying position by the main conveyor assembly 54, the air knife 270 is able to provide a sufficient diverting force with the divert air flow to divert the products from the main conveyor assembly 54. The speed of the product handling apparatus 30 is greatly increased due to the use of the diverter assemblies 262 including air knifes 270, instead of mechanical diverter mechanisms, as described above.

As discussed above, the product collection locations 50 include non-customer product collection locations and customer order product collection locations. As shown in FIG. 2, the main conveyor assembly 54 first conveys products through some non-customer product collection location 294. Several of the non-customer product collection locations 294 are positioned downstream of the product labeling area 42. These non-customer product collection locations 294 include an early divert location 296, a no-read divert location 298 and a no-need divert location 300.

Each of the non-customer product collection locations 294 is typically provided by (see FIG. 19) a sort bin 304 into which products are diverted. In the sort bin 304, the products are not collected in an arranged manner. The sort bin 304 includes a hinged door 308 which is opened by an operator to access the products in the sort bin 304. The hinged door 308 includes a latch (not shown), and a locking pin (not shown) locks the hinged door 308 in the closed position during sorting operations.

When the sort bin 304 is full, the main controller 58 will stop sending products to the sort bin 304 and controls an indicator (not shown) to notify the operator that the sort bin 304 must be emptied. When the indicator is activated to signal a full sort bin 304, scanning of an appropriate box by the operator causes the sort bin 304 to automatically become available for loading. To unload the sort bin 304, the operator will activate a switch (not shown) on the sort bin 304 to release the locking pin. The hinged door 308 is then opened, and the products are removed from the sort bin 304. Once the sort bin 304 is emptied, the hinged door 308 is closed and latched by the operator. This causes the main controller 58 to re-engage the locking pin and to make the sort bin 304 available to again receive products.

The switch also enables the operator to take the sort bin 304 off-line and to signal to the main controller 58 to stop sending products to the sort bin 304. While the sort bin 304 is off-line, no products will be diverted to the sort bin 304. The operator brings the sort bin 304 back on-line by again depressing the switch.

Once a product is identified in the product identification area 42, the main controller 58 determines if a customer order product collection location 50 is available and ready to receive the product. If there is no product collection location 50 ready to receive the product, the main controller 58 will output an early divert signal to the diverter controller 282 of the diverter assembly 262 associated with the early divert location 296. The air knife 270 will produce a divert air flow to divert the product into the early divert location 296. Products diverted into the early divert location 296 are removed and returned to the product induct area 34 by the operator for handling at a later time by the product handling apparatus 30.

If the array of bar code readers 210 in the product identification area 38 outputs a no-read signal to the main controller 58 (because the product bar code cannot be read) or if the label verification bar code reader 260 outputs a label error signal to the main controller 58 (because the product has been mislabeled), the main controller 58 will output a no-read signal to the diverter controller 282 of the diverter assembly 262 associated with the no-read divert location 298. The air knife 270 will produce a divert air flow to divert the "no-read" product into the no-read divert location 298. "No-read" products will be removed from the no-read divert location 298, possibly re-labeled and returned to the product induct area 34 by an operator. Alternatively, the "no-read" products can be manually sorted into the proper customer order.

If, after identifying the product, the main controller 58 determines that the product is not needed for the wave of customer orders, the main controller 58 outputs a no-need signal to the diverter controller 282 of the diverter assembly 262 associated with the no-need divert location. The air knife 270 produces a divert air flow to divert the unneeded product into the no-need divert location 300. Unneeded products will be collected from the no-need divert location 300 and returned to the warehouse locations.

If a product is properly identified in the product identification area 38, confirmed by the main controller 58 as being assigned to a customer order and a customer order product collection location 50 and properly labeled, the main controller will output a divert signal to the diverter controller 282 of a diverter assembly 262 of (see FIGS. 21–22) a customer order product collection location 312 assigned to collect the product. The product will then be diverted by the diverter assembly 262 into the assigned customer order product collection location 312.

Customer order product collection locations 312 are provided by (see FIGS. 21–22) sets of stacker assemblies 316 and product sort bins 320. Each set preferably includes two stacker assemblies 316 and a sort bin 320 and may be used to collect a single customer order. Alternatively, each component of a set, each stacker assembly 316 and the sort bin 320, may be used to receive a separate customer order. Each customer order product collection location 312 includes an associated diverter assembly 262.

The sort bin 320 is similar to the sort bin 304 of the non-customer product collection locations 294, as described above. In the sort bin 320, the products are not collected in an arranged manner. The sort bin 320 includes a hinged door 324 which is opened by an operator to access the products in the sort bin 320. The hinged door 324 includes a latch (not shown), and a locking pin (not shown) locks the hinged door 324 in the closed position during sorting operations.

When the sort bin 320 is full, the main controller 58 will stop sending products to the sort bin 320 and controls an indicator (not shown) to notify the operator that the sort bin 320 must be emptied. When the indicator is activated to signal a full sort bin 320, scanning of an appropriate box B by the operator causes the sort bin 320 to automatically become available for loading. To unload the sort bin 320, the operator will activate a switch (not shown) on the sort bin 320 to release the locking pin. The hinged door 324 is then opened, and the products are removed from the sort bin 320. Once the sort bin 320 is emptied, the hinged door 324 is closed and latched by the operator. This causes the main controller 58 to re-engage the locking pin and to make the sort bin 320 available to again receive products.

The switch also enables the operator to take the sort bin 320 off-line and to signal to the main controller 58 to stop sending products to the sort bin 320. While the sort bin 320 is off-line, no products will be diverted to the sort bin 320. The operator brings the sort bin 320 back on-line by again depressing the switch.

Figure 23:
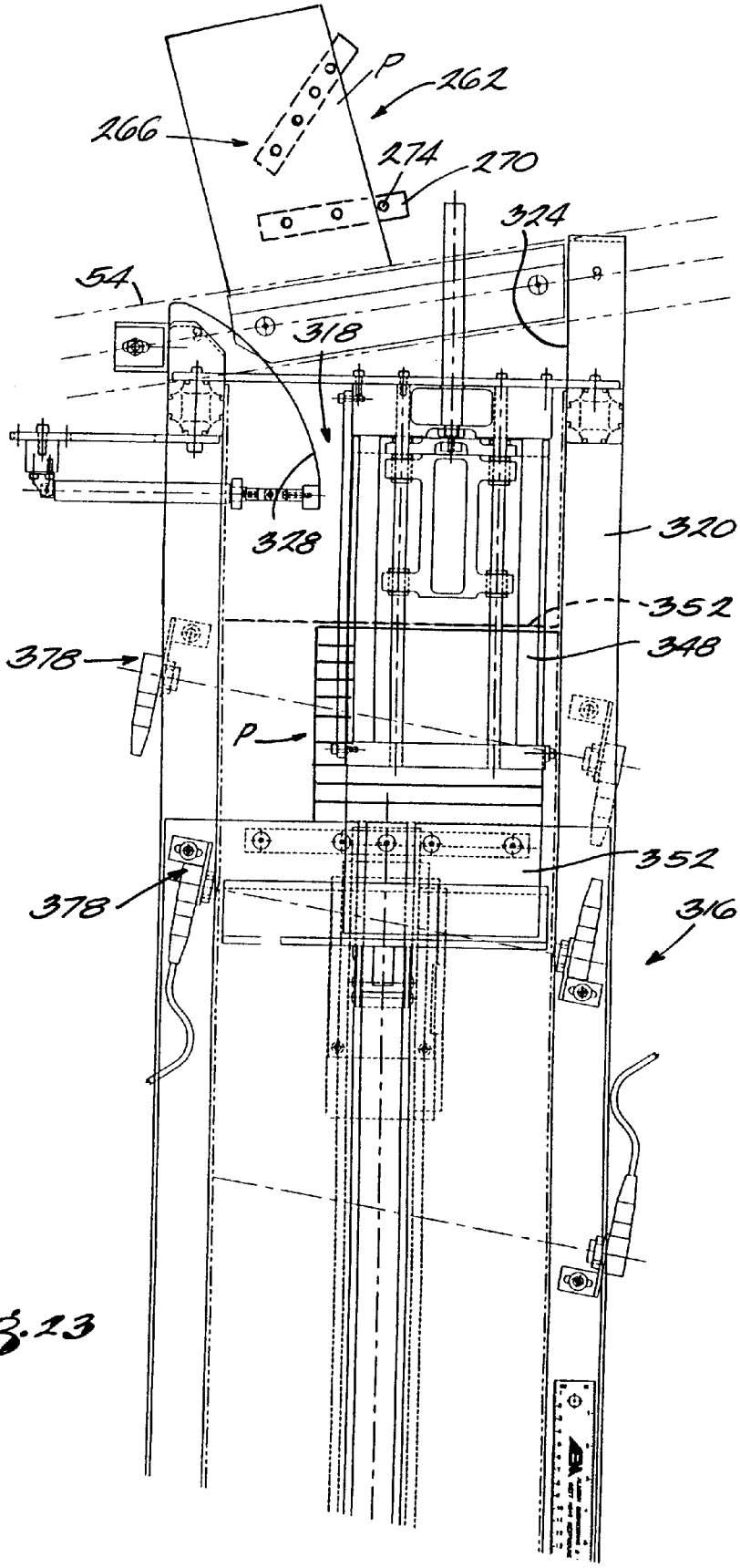
FIG. 23 is an enlarged and more detailed view of a portion of a stacker assembly illustrated in FIG. 22.
Figure 14:
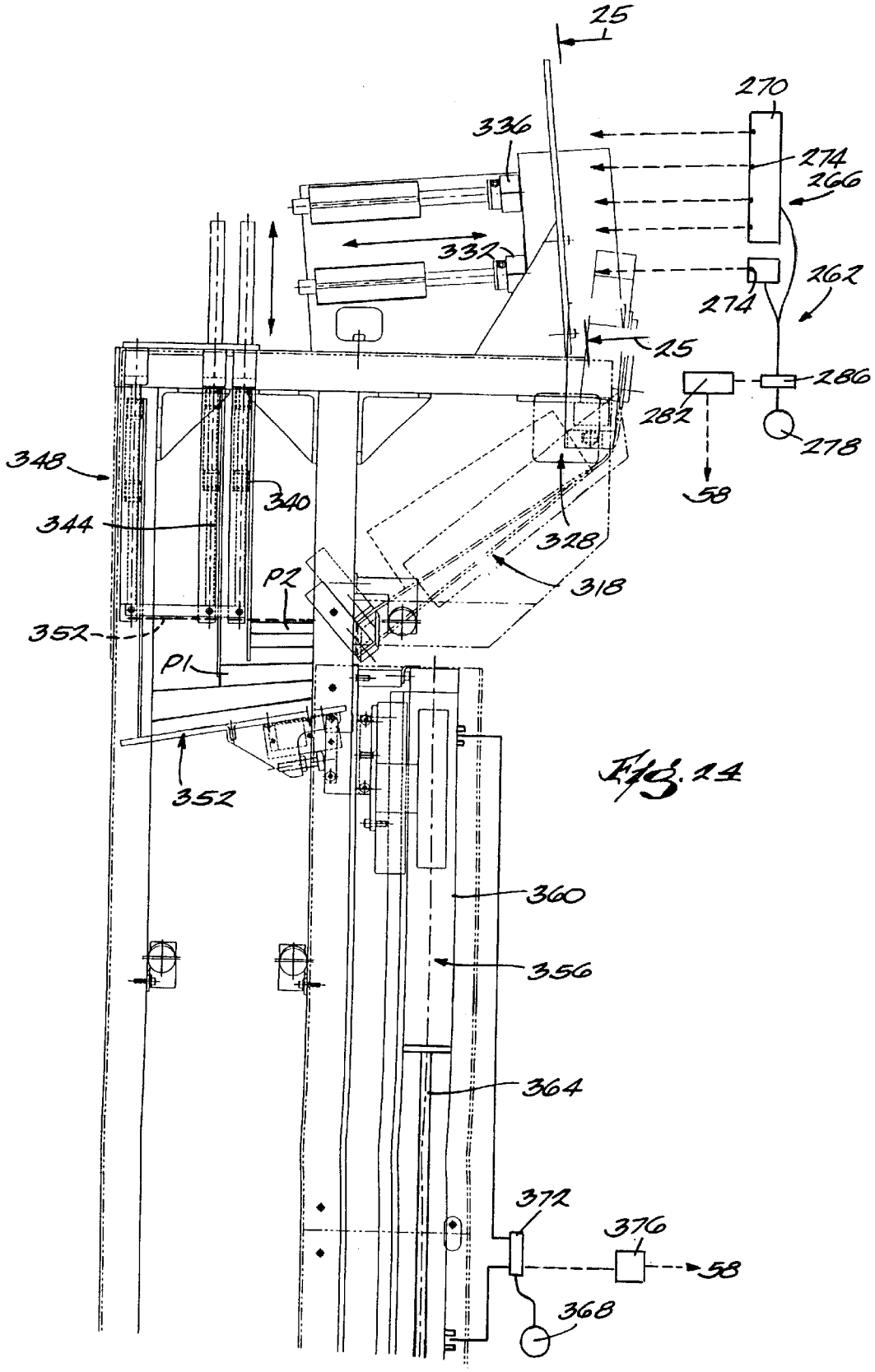

As shown in more detail FIGS. 23–24, in each stacker assembly 316, products are stacked in an organized and arranged manner in a product stack. Each stacker assembly 316 provides a curved product chute 318 and uses the product's momentum, created by the movement on the main conveyor assembly 54 and by the diverter force of the diverter assembly 262, and gravity to guide the product flat onto a product stack.

The stacker assembly 316 includes a product collection housing 320 having spaced apart side walls and a rear wall positioned adjacent the main conveyor assembly 54. An aperture 324 is defined in the product collection housing 320. The stacker assembly 316 also includes a movable throat member 328 which defines a portion of the aperture 324 and which aids in guiding products into the product chute 318.

Figure 25:
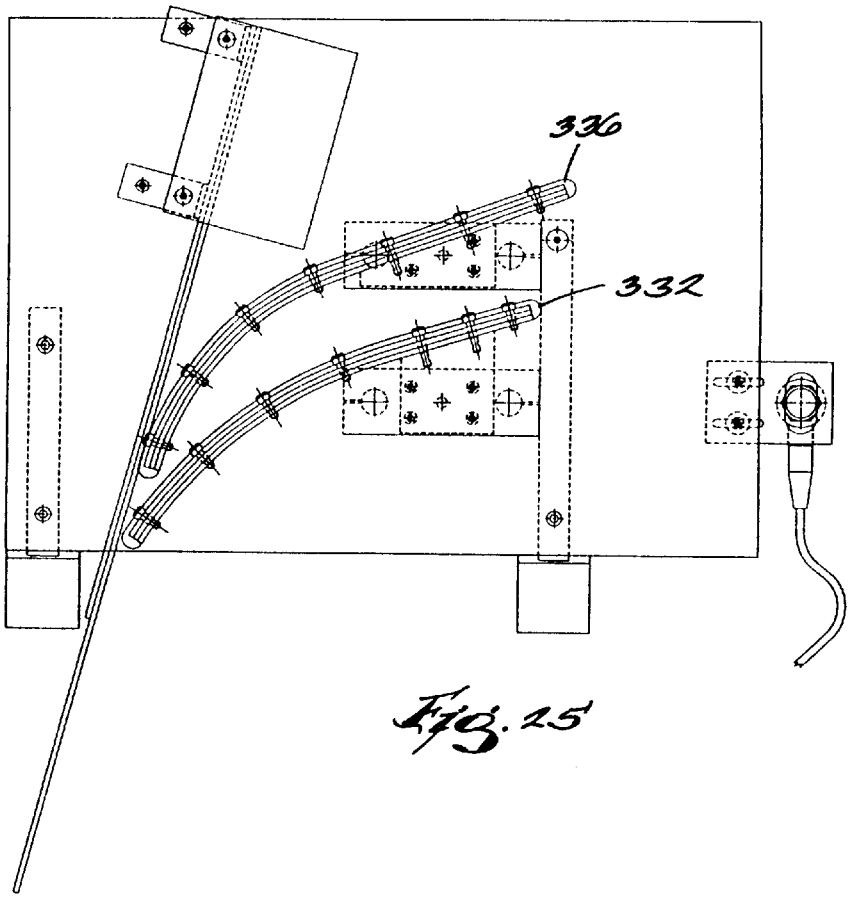
FIG. 25 is a view of a guide assembly taken generally along line 25—25 in FIG. 24.

The stacker assembly 316 also includes (see FIGS. 23 and 25) a plurality of guide members, such as a first guide member 332 and a second guide member 316, which are movable to define the upper portion of the aperture 324 and the product chute 318. As shown in FIGS. 22–23, a plurality of front plates, such as first, second and third front plates 340, 344 and 348, define the front wall of a portion of the product collection housing 320. The front plates 340, 344 and 348 are movable to change the width (transverse to the conveying axis 32) of the portion of the product collection housing 320 to assist in orderly stacking of the products.

The stacker assembly 316 also includes a movable stack plate 352 which provides a bottom wall in the product collection housing 320. Products are diverted through the aperture 324 and down the product chute 318 and are stacked in a flat orientation on the stack plate 352. Initially, as shown in phantom in FIGS. 23–24, the stack plate 352 is positioned to define an initial length of the product chute 318 and to provide a surface onto which products are stacked. As products are stacked on the stack plate 352, the uppermost product P defines the length of the product chute and provides the surface onto which subsequent products are stacked. The stack plate 352 is movable relative to the product collection housing 320 so that the subsequent length of the product chute 318, defined by the uppermost product, is substantially the same as the initial length, defined by the initial position of the stack plate 352 (shown in phantom in FIGS. 23–24), to provide a consistent product chute 318 and stacking surface. In other words, as the product stack is built, the stack plate 352 lowers to maintain a consistent vertical distance between the product chute 318 and the top of the product stack, helping to maintain consistent stacking orientation.

To move the stack plate 352, the stacker assembly 316 includes (see FIG. 24) a cylinder assembly 356 connected to the stack plate 352. The cylinder assembly 356 includes a cylinder 360 and a piston 364 movably housed in the cylinder 360. The cylinder 360 is connected to the stack plate 352 to move the stack plate 352. The cylinder assembly 356 has first and second ports through which fluid is selectively supplied to move the piston 364 relative to the cylinder 360. The cylinder assembly 356 also includes an air supply 368 (schematically illustrated) for supplying fluid to the cylinder assembly 356. A stack plate valve 372 controls fluid flow to the cylinder assembly 356 to control movement of the stack plate 352. Preferably, the cylinder assembly 356 is pressurized on both sides, and pressure is released from one side of the cylinder assembly 356 to allow the stack plate 352 to be lowered. The pneumatic control of the stack plate 352 provides smooth movement of the stack plate 352 as the stack plate 352 is lowered and products are stacked.

The stacker assembly 316 also includes a stacker controller 376. The stacker controller 376 controls operation of the stack plate valve 372 to move the stack plate 352 as products are stacked in the stacker assembly 316.

The stacker controller 376 also controls positioning of the throat member 328, the guide members 332 and 336 and the front plates 340, 344 and 348 to define an appropriate size of the product chute 318 for a given product configuration. The stacker controller 376 receives a stack signal from the main controller 58 indicating the product configuration of products being conveyed to the stacker assembly 316. Accordingly, the stacker controller 376 adjusts the throat member 328, the guide members 332 and 336 and the front plates 340, 344 and 348 to accommodate the desired product configuration. If a product having a different product configuration is conveyed to the stacker assembly 316, the stacker controller 376 adjusts the throat member 328, the guide members 332 and 336 and the front plates 340, 344 and 348 to accommodate the different product configuration.

In the illustrated construction, when stacking products in a stacker assembly 316, products are preferably stacked in the following order from bottom of the order to top of the order: clam shell videocassettes, DVDs, sleeve videocassettes, CDs, double CDs and cassette tapes. The controlled staging and induction of products in the product induct area 34 by different product configuration should eliminate the assignment of a product to a stacker assembly which cannot accept the product because of a previously stacked product. However, if this event occurs, the product will be sent to another customer order product collection location corresponding to the customer order, if available, to the early divert location 296 or to the product collection location 50 at the end of the product handling apparatus 30.

During processing of stackable products, each product assigned to a customer order will be diverted to the available stacker assembly 316 associated with that customer order. When possible, products will continue to be sent to that stacker assembly 316 until a box is completed. A stacker assembly 316 having a full stack will require emptying by the operator and will become unavailable to receive additional products. The next product for that customer order will be sent to another customer order product collection location 312 corresponding to that customer order.

Photo eye and receptor sets 378 output a stack status signal to the main controller 58 to provide information on the status of stacking operations in the stacker assembly 316. When a full stack is present, the stack status signal alerts the main controller 58. If accidentally blocked, the photo eye and receptor sets 378 may also provide a stop signal to the main controller 58 to stop sorting operations in the stacker assembly 316 because, for example, an operator has a body part in the product chute 318.

An indicator (not shown) for each stacker assembly 316 alerts an operator when the stacker assembly 316 requires attention. When a product stack in the stacker assembly 316 is completed, the main controller 58 will stop sending products to the stacker assembly 316 and will output a full stack signal to the indicator so that the operator will empty the full stack from the stacker assembly 316. When the full stack indicator is activated, scanning of the appropriate box B by the operator will cause the stacker assembly 316 to automatically move to an unloading position. The stacker controller 376 will cause the stack plate 352 to drop further, allowing the operator to access the full stack. The operator will then remove the full stack as is most convenient. As products are removed from the top of the full stack, the stacker controller 376 will cause the stack plate 352 to rise to provide a consistent top of the product stack elevation to ease unloading for the operator.

Figure 21:
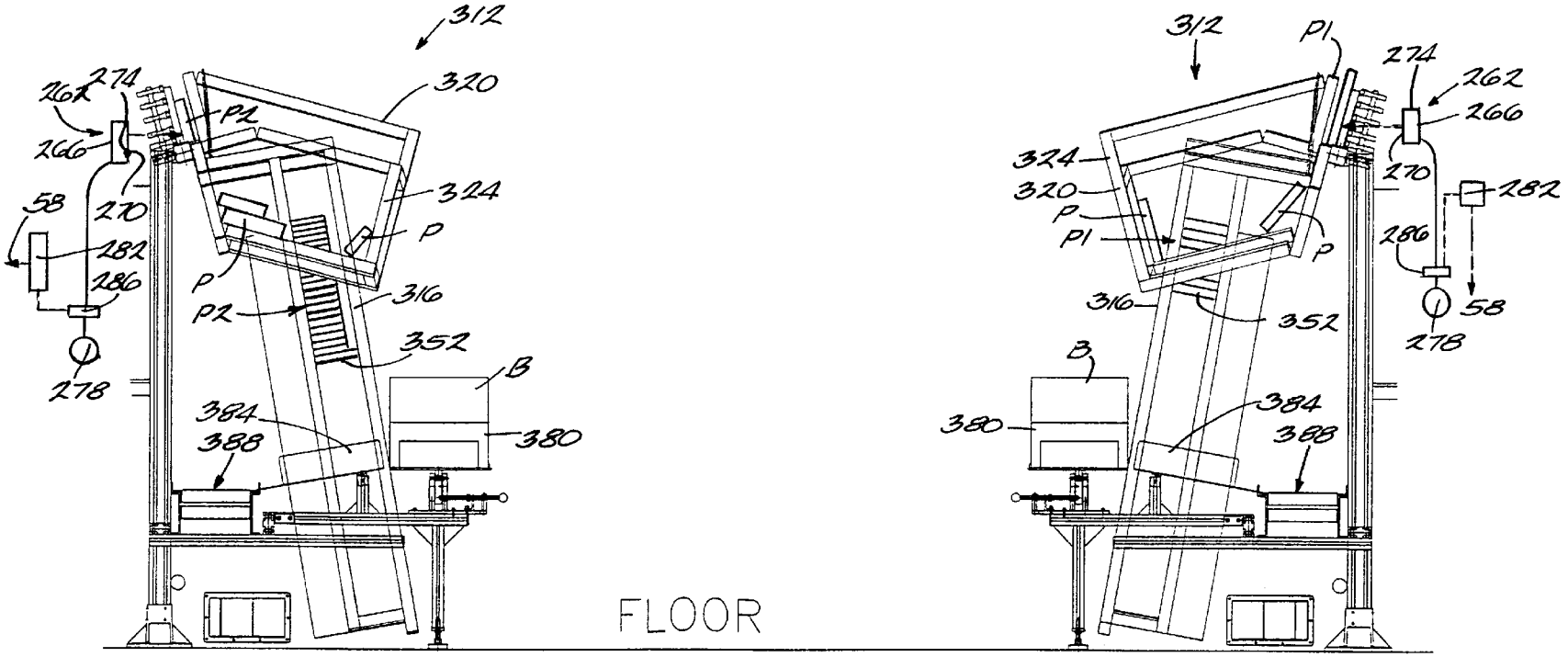
FIG. 21 is a view of a portion of a product sorting area taken generally along line 21—21 in FIG. 1.
Figure 11:
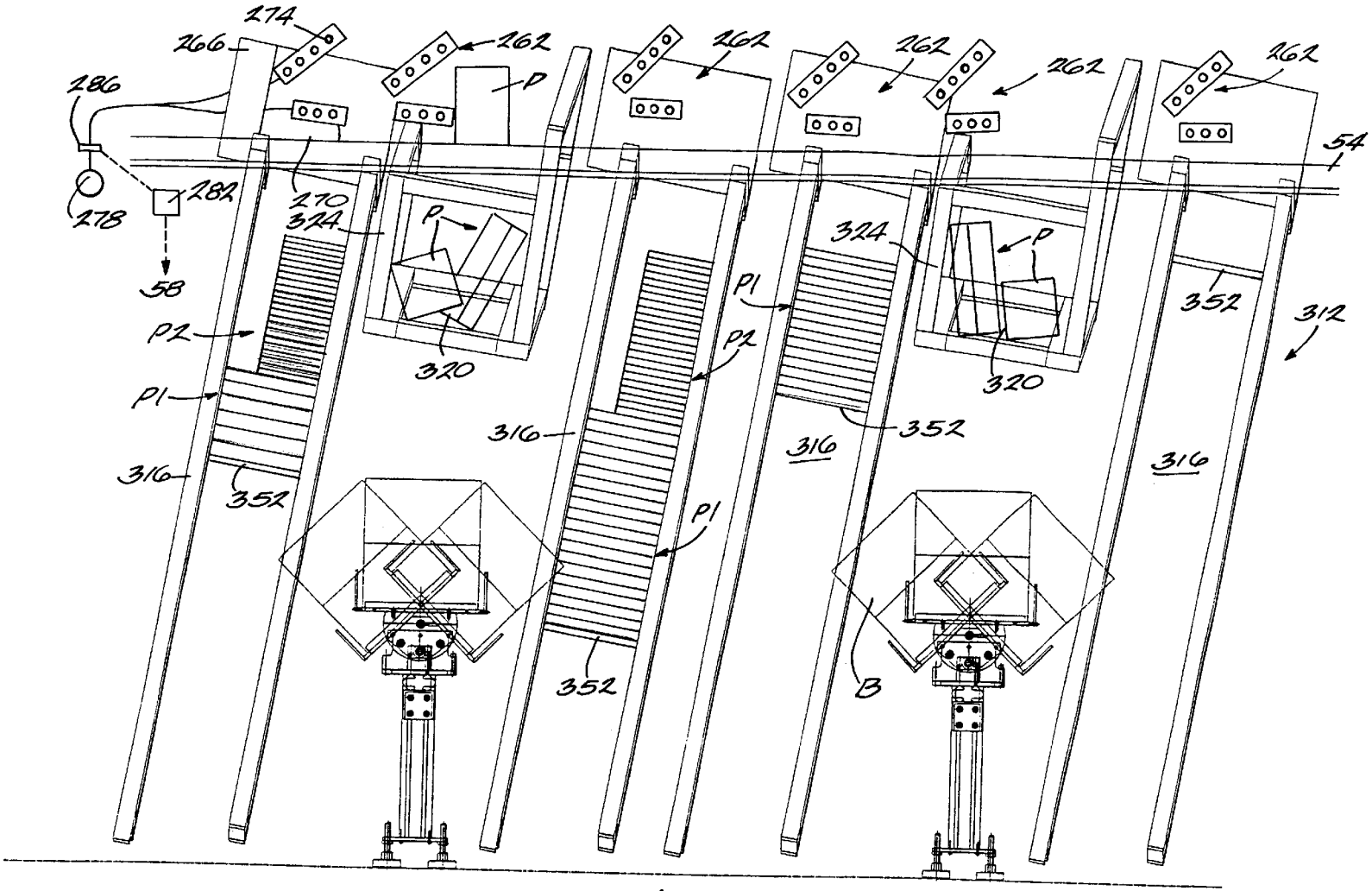

As shown in FIGS. 21–22, a box holder 380 is positioned with each customer order product collection location 312 or stacker set. A box B is supported on the box holder 380 and full product stacks are loaded into the box B by an operator. Completed boxes B are placed on a gravity feed roller conveyor 384 associated with each stacker set. The completed boxes B are pushed by the operator onto a completed box conveyor assembly 388. The completed box conveyor assembly 388 is a powered roller conveyor which runs underneath the product collection locations 50 and which transports the completed box B from the product handling apparatus 30.

As discussed above, non-conveyable products are collected and handled in another manner, such as manually, in which the non-conveyable products are identified, labeled and sorted into each individual customer order. After the conveyable products are handled by the product handling apparatus 30, the sorted conveyable products and the sorted non-conveyable products may be collected and packaged together in an individual customer order.

Once the operator has emptied the stacker assembly 316, the operator will depress a stacker switch (not shown) to provide an empty stacker signal to the main controller 58. The main controller 58 will then reset the stacker assembly 316 and make the stacker assembly 316 available to again receive products. The stacker switch also allows the operator to take the stacker assembly 316 off-line. When a stacker assembly 316 is off-line, no products will be diverted to the stacker assembly 316. To bring the stacker assembly 316 back on-line, the operator again depresses the switch, and products will again be diverted to the stacker assembly 316.

If a product passes all of the customer order product collection locations 312 without being diverted, the product will be conveyed to an end-of-the-line product collection location 390 as shown in FIG. 1. The end-of-the-line product collection location 390 includes a sort bin 304, as described above. Products in the end-of-the-line product collection location 390 are collected by an operator and may be re-processed through the product handling apparatus 30.

The main controller 58 includes a software program for controlling the product handling apparatus 30. The main controller 58 includes (see FIG. 1) an information storage location 392 for receiving and storing wave information corresponding to customer orders. The main controller 58 also includes a control location 394 for receiving signals from and for outputting control signals to components of the product handling apparatus 30.

As described above, the wave information is stored in the main controller 58, and the wave session is initiated. As products are identified, the main controller 58 receives the associated identification signal from the bar code readers 210 corresponding to the bar code information on a product. The main controller 58 then conducts a look-up and compares the information in the identification signal with the wave information corresponding to the customer order information. Based on the identification signal and the customer order information, the main controller 58 outputs signals to the components of the product handling apparatus 30 to control the components to process the products.

For each product requiring a label, the main controller 58 outputs the label signal to the label controller 248 associated with a labeler assembly 218. If the product requires a printed label, as indicated in the customer information, the label signal indicates this, and the label controller 248 controls the associated printer 226.

The main controller 58 also outputs a balancing force signal to the balancing force controller for the balancing force applicator associated with the labeler assembly 218. As the product is conveyed from the labeler assemblies 218, the main controller 58 outputs a second balancing force signal to the second balancing force controller to control the second balancing force applicator to provide the second balancing force air flow.

The main controller 58 receives a label verification signal from the bar code reader 260. The label verification signal indicates whether the proper label was properly applied to a product. The main controller 58 then outputs a divert signal. If the label verification signal indicated that the proper label was properly applied to a product, the product will be diverted into a customer order product collection location 312 assigned to the customer order. If the label verification signal indicated that the product was mislabeled, the main controller 58 will output a divert signal to divert the product to the no-read product collection location 298.

When a stacker assembly 316 is full, the main controller 58 will receive a stacker full signal. The main controller 58 will output a stacker full indication signal to control the indicator. When the stacker assembly 316 is empty, the main controller 58 will receive the stacker empty signal and will reset the stacker assembly 316, allowing products to again be diverted to the stacker assembly 316.

The main controller 58 thus electronically communicates with and controls the components of the product handling apparatus 30.

Various features of the invention are set forth in the following claims.

We claim:

1. A feeder assembly for use in a product handling apparatus for handling multiple products, each product having opposite faces and a bottom edge, a top edge, a leading edge and a trailing edge, said feeder assembly comprising:

a feed conveyor assembly including a feed conveyor belt for supporting products in face-to-face relation in a feed stack having a first end and a second end, said feed conveyor belt being engageable with the bottom edge of each product in the feed stack to support the products, said feed conveyor belt feeding products in a feed direction toward the first end of the feed stack; and a strip-off conveyor assembly including a strip-off conveyor belt having a strip-off direction substantially perpendicular to the feed direction, said strip-off conveyor belt having a belt surface and a plurality of cleat members spaced apart in the strip-off direction and extending from said belt surface, said belt surface being generally coplanar with one face of the product at the first end of the feed stack, said belt surface being positioned to engage a portion of the one face of the product at the first end of the feed stack and one of said plurality of cleat members being engageable with the trailing edge of the product to strip the product at the first end of the feed stack from the feed stack.

2. The feeder assembly as set forth in claim 1 wherein said strip-off conveyor assembly further includes a support member extending substantially parallel to said strip-off conveyor belt and having a smooth, low-friction support surface engageable with the bottom edge of the product to support the product.

3. The feeder assembly as set forth in claim 1 wherein said strip-off conveyor assembly supports the product in a conveying position in which the one face of the product is in a non-horizontal and non-vertical orientation.

4. The feeder assembly as set forth in claim 3 wherein said strip-off conveyor assembly supports the product in a conveying position in which the one face of the product is angled at least 70° from a horizontal plane.

5. The feeder assembly as set forth in claim 1 wherein each product has a width extending in the feed direction, and wherein said feeder assembly further comprises a back pressure assembly for controlling strip-off of products from the feed conveyor assembly, said back pressure assembly including a back pressure door engageable with the leading edge of products in the feed stack and selectively positionable relative to said strip-off conveyor belt to define a space smaller than the width of more than one product.

6. The feeder assembly as set forth in claim 1 and further comprising a hold-off plate movable into engagement with products in the feed stack to selectively maintain the products in the feed stack in spaced relation from said strip-off conveyor assembly.

7. The feeder assembly as set forth in claim 1 wherein each product has a height along the trailing edge, and wherein said one of said plurality of cleat members engages the trailing edge of the product at a distance from the bottom edge of the product to prevent the product from tipping.

8. The feeder assembly as set forth in claim 3 wherein said strip-off conveyor assembly supports the product in the conveying position in which the one face of the product is angled at least about 20° from a vertical plane.

9. A feeder assembly for use in a product handling apparatus for handling multiple products, each product having opposite faces and a bottom edge, a top edge, a leading edge and a trailing edge, said feeder assembly comprising:

a feed conveyor assembly including a feed conveyor belt for supporting products in face-to-face relation in a feed stack having a first end and a second end, said feed conveyor belt being engageable with the bottom edge of each product in the feed stack to support the products, said feed conveyor belt feeding products in a feed direction toward the first end of the feed stack; and a strip-off conveyor assembly including a strip-off conveyor belt having a strip-off direction substantially perpendicular to the feed direction, said strip-off conveyor belt having a belt surface and a plurality of cleat members spaced apart in the strip-off direction and extending from said belt surface, said belt surface being generally coplanar with one face of the product at the first end of the feed stack, said belt surface being positioned to engage a portion of the one face of the product at the first end of the feed stack and one of said plurality of cleat members being engageable with the trailing edge of the product to strip the product at the first end of the feed stack from the feed stack;

wherein each product has a width extending in the feed direction, and wherein said feeder assembly further comprises a back pressure assembly for controlling strip-off of products from the feed conveyor assembly, said back pressure assembly including a back pressure door engageable with the leading edge of products in the feed stack and selectively positionable relative to said strip-off conveyor belt to define a space smaller than the width of more than one product;

wherein each of a plurality of first products has a first width and each of a plurality of second products has a second width, the first width and the second width being different, and wherein said back pressure door is selectively positionable in a first back pressure position, to define a space smaller than the width of more than one first product to control strip-off of first products from said feed conveyor assembly, and in a second back pressure position, to define a space smaller than the width of more than one second product to control strip-off of second products from said feed conveyor assembly.

10. A diverter assembly for diverting products from a conveyor assembly, each product having opposite faces and a bottom edge, the conveyor assembly including a lower member engageable with the bottom edge of each product to support the product, the conveyor assembly supporting the products in a conveying position in which one face of each product is in a non-horizontal orientation, the conveyor assembly conveying the products in a conveying direction, each product having a direction of movement, said diverter assembly comprising:

a diverter mechanism supported adjacent the conveyor assembly and operable to redirect the direction of movement of products from the conveying direction, said diverter mechanism including an air knife selectively producing an air flow against one face of a product to divert the product from the conveying direction;

wherein a first product has a first product configuration and a second product has a second product configuration, the first product configuration and the second product configuration being different, and wherein said diverter assembly further comprises a controller for controlling said air knife to selectively produce a first air flow to divert the first product and a second air flow to divert the second product, said first air flow and said second air flow being different.

11. The diverter assembly as set forth in claim 10 wherein the controller controls said air knife to produce said air flow to divert a first product and to not produce said air flow to not divert a third product.

12. A diverter assembly for diverting products from a conveyor assembly, each product having opposite faces and a bottom edge, the conveyor assembly including a lower member engageable with the bottom edge of each product to support the product, the conveyor assembly supporting the products in a conveying position in which one face of each product is in a non-horizontal orientation, the conveyor assembly conveying the products in a conveying direction, each product having a direction of movement, said diverter assembly comprising:

a diverter mechanism supported adjacent the conveyor assembly and operable to redirect the direction of movement of products from the conveying direction, said diverter mechanism including an air knife selectively producing an air flow against one face of a product to divert the product from the conveying direction;

wherein a first product has a first product configuration and a second product has a second product configuration, the first product configuration and the second product configuration being different, wherein said diverter mechanism further includes means for varying said air flow so that said air knife selectively produces a first air flow to divert the first product and a second air flow to divert the second product, said first air flow and said second air flow being different.

13. A stacker assembly for stacking products, each product having opposite faces and a bottom edge, the products being conveyed to said stacker assembly by a conveyor assembly, the conveyor assembly including a lower member engageable with the bottom edge of each product to support the product, the conveyor assembly supporting the products in a conveying position in which one face of each product is in a non-horizontal orientation, said stacker assembly comprising:

a product collection housing in which products are collected; and a diverter assembly for selectively diverting a product from the conveyor assembly, said diverter assembly including a diverter mechanism supported adjacent the conveyor assembly, said diverter mechanism including an air knife selectively producing an air flow against one face of a product to divert the product from the conveyor assembly and into said product collection housing;

wherein a first product has a first product configuration and a second product has a second product configuration, the first product configuration and the second product configuration being different, and wherein said diverter assembly further comprises a controller for controlling said air knife to selectively produce a first air flow to divert the first product and a second air flow to divert the second product, said first air flow and said second air flow being different.

14. The stacker assembly as set forth in claim 13 wherein the controller controls said air knife to produce said air flow to divert a first product and to not produce said air flow to not divert a third product.

15. A stacker assembly for stacking products, each product having opposite faces and a bottom edge, the products being conveyed to said stacker assembly by a conveyor assembly, the conveyor assembly including a lower member engageable with the bottom edge of each product to support the product, the conveyor assembly supporting the products in a conveying position in which one face of each product is in a non-horizontal orientation, said stacker assembly comprising:

a product collection housing in which products are collected; and a diverter assembly for selectively diverting a product from the conveyor assembly, said diverter assembly including a diverter mechanism supported adjacent the conveyor assembly, said diverter mechanism including an air knife selectively producing an air flow against one face of a product to divert the product from the conveyor assembly and into said product collection housing;

wherein a first product has a first product configuration and a second product has a second product configuration, the first product configuration and the second product configuration being different, wherein said diverter mechanism further includes means for varying said air flow so that said air knife selectively produces a first air flow to divert the first product and a second air flow to divert the second product, said first air flow and said second air flow being different.

16. A stacker assembly for stacking products, each product having opposite faces and a bottom edge, the products being conveyed to said stacker assembly by a conveyor assembly, the conveyor assembly including a lower member engageable with the bottom edge of each product to support the product, the conveyor assembly supporting the products in a conveying position in which one face of each product is in a non-horizontal orientation, said stacker assembly comprising:

a product collection housing in which products are collected;

a diverter assembly for selectively diverting a product from the conveyor assembly, said diverter assembly including a diverter mechanism supported adjacent the conveyor assembly, said diverter mechanism including an air knife selectively producing an air flow against one face of a product to divert the product from the conveyor assembly and into said product collection housing;

wherein said product collection housing defines an aperture through which products are moved from the conveyor assembly into said product collection housing;

wherein said stacker assembly further comprises a throat member defining a portion of said aperture;

wherein a first product has a first product configuration and a second product has a second product configuration, the first product configuration and the second product configuration being different, and wherein said throat member is selectively movable relative to the product collection housing to define a first size of said aperture so that a first product is divertable through said aperture and a second size of said aperture so that a second product is divertable through said aperture.

17. A stacker assembly for stacking products, each product having opposite faces and a bottom edge, the products being conveyed to said stacker assembly by a conveyor assembly, the conveyor assembly including a lower member engageable with the bottom edge of each product to support the product, the conveyor assembly supporting the products in a conveying position in which one face of each product is in a non-horizontal orientation, said stacker assembly comprising:

a product collection housing in which products are collected;

a diverter assembly for selectively diverting a product from the conveyor assembly, said diverter assembly including a diverter mechanism supported adjacent the conveyor assembly, said diverter mechanism including an air knife selectively producing an air flow against one face of a product to divert the product from the conveyor assembly and into said product collection housing;

a product guide positioned relative to the conveyor assembly to define a portion of a product chute; and a stack plate providing a bottom wall in said product collection housing and onto which products are stacked, wherein a product diverted from the conveyor assembly travels through said product chute and is stacked on said stack plate in a flat orientation relative to said stack plate;

wherein said product chute has a size, and wherein said product guide is movable to change the size of said product chute.

18. A stacker assembly for stacking products, each product having opposite faces and a bottom edge, the products being conveyed to said stacker assembly by a conveyor assembly, the conveyor assembly including a lower member engageable with the bottom edge of each product to support the product, the conveyor assembly supporting the products in a conveying position in which one face of each product is in a non-horizontal orientation, said stacker assembly comprising:

a product collection housing in which products are collected; and a diverter assembly for selectively diverting a product from the conveyor assembly, said diverter assembly including a diverter mechanism supported adjacent the conveyor assembly, said diverter mechanism including an air knife selectively producing an air flow against one face of a product to divert the product from the conveyor assembly and into said product collection housing;

wherein a first product has a first product configuration and a second product has a second product configuration, the first product configuration and the second product configuration being different, and wherein said stacker assembly further comprises:

a first product guide movably positioned relative to the conveyor assembly to define a product chute having a first size;

a second product guide movably positioned relative to the conveyor assembly to define a product chute having a second size; and a stack plate providing a bottom wall in said product collection housing and onto which products are stacked;

wherein, when a first product is to be diverted into said product collection housing, said first product guide is positioned to define said first size so that a first product travels through said product chute and is stacked on said stack plate in a flat orientation relative to said stack plate, and wherein, when a second product is to be diverted into said product collection housing, said second product guide is positioned to define said second size so that a second product travels through said product chute and is stacked on said stack plate in a flat orientation relative to said stack plate.

19. A stacker assembly for stacking products, each product having opposite faces and a bottom edge, the products being conveyed to said stacker assembly by a conveyor assembly, the conveyor assembly including a lower member engageable with the bottom edge of each product to support the product, the conveyor assembly supporting the products in a conveying position in which one face of each product is in a non-horizontal orientation, said stacker assembly comprising:

a product collection housing in which products are collected; and a diverter assembly for selectively diverting a product from the conveyor assembly, said diverter assembly including a diverter mechanism supported adjacent the conveyor assembly, said diverter mechanism including an air knife selectively producing an air flow against one face of a product to divert the product from the conveyor assembly and into said product collection housing;

wherein each product further has a top edge, a leading edge and a trailing edge, and wherein said stacker assembly further comprises a front plate positioned relative to said product collection housing to define a portion of a product chute, wherein a product diverted from the conveyor assembly travels through said product chute and is stacked on said stack plate in a flat orientation relative to said stack plate, and wherein said front plate is engageable with one edge of the product as the product is stacked on said stack plate;

wherein said product chute has a size, and wherein said front plate is movable to change the size of said product chute.

20. A stacker assembly for stacking products, each product having opposite faces and a bottom edge, the products being conveyed to said stacker assembly by a conveyor assembly, the conveyor assembly including a lower member engageable with the bottom edge of each product to support the product, the conveyor assembly supporting the products in a conveying position in which one face of each product is in a non-horizontal orientation, said stacker assembly comprising:

a product collection housing in which products are collected; and a diverter assembly for selectively diverting a product from the conveyor assembly, said diverter assembly including a diverter mechanism supported adjacent the conveyor assembly, said diverter mechanism including an air knife selectively producing an air flow against one face of a product to divert the product from the conveyor assembly and into said product collection housing;

wherein each product further has a top edge, a leading edge and a trailing edge, and wherein said stacker assembly further comprises a front plate positioned relative to said product collection housing to define a portion of a product chute, wherein a product diverted from the conveyor assembly travels through said product chute and is stacked on said stack plate in a flat orientation relative to said stack plate, and wherein said front plate is engageable with one edge of the product as the product is stacked on said stack plate;

wherein a first product has a first product configuration and a second product has a second product configuration, the first product configuration and the second product configuration being different, and wherein said stacker assembly further comprises:

a first front plate movably positioned relative to the conveyor assembly to define a product chute having a first size;

a second front plate movably positioned relative to the conveyor assembly to define a product chute having a second size; and a stack plate providing a bottom wall in said product collection housing and onto which products are stacked;

wherein, when a first product is to be diverted into said product collection housing, said first front plate is positioned to define said first size so that a first product travels through said product chute and is stacked on said stack plate in a flat orientation relative to said stack plate, said first front plate being engageable with one edge of the first product as the first product is stacked on said stack plate, and wherein, when a second product is to be diverted into said product collection housing, said second front plate is positioned to define said second size so that a second product travels through said product chute and is stacked on said stack plate in a flat orientation relative to said stack plate, said second front plate is engageable with one edge of the second product as the second product is stacked on said stack plate.

21. A stacker assembly for stacking products, each product having opposite faces and a bottom edge, the products being conveyed to said stacker assembly by a conveyor assembly, the conveyor assembly including a lower member engageable with the bottom edge of each product to support the product, the conveyor assembly supporting the products in a conveying position in which one face of each product is in a non-horizontal orientation, said stacker assembly comprising:

a product collection housing in which products are collected; and a diverter assembly for selectively diverting a product from the conveyor assembly, said diverter assembly including a diverter mechanism supported adjacent the conveyor assembly, said diverter mechanism including an air knife selectively producing an air flow against one face of a product to divert the product from the conveyor assembly and into said product collection housing;

wherein said product collection housing defines a housing axis, and wherein said stacker assembly further comprises a stack plate providing a bottom wall in said product housing and onto which products are stacked, said stack plate being movable relative to said product collection housing along said housing axis.

22. The stacker assembly as set forth in claim 21 wherein said product collection housing defines a portion of a product chute, wherein, before a product is stacked on said stack plate, said stack plate defines an initial length of said product chute, wherein, as products are stacked on said stack plate, an uppermost product defines a subsequent length of said product chute, and wherein, as products are stacked on said stack plate, said stack plate is movable so that said subsequent length remains substantially the same as said initial length.

23. The stacker assembly as set forth in claim 21 and further comprising a cylinder assembly for moving said stack plate, said cylinder assembly including a cylinder and a piston movably housed in said cylinder, one of said piston and said cylinder being connected to said stack plate so that said stack plate is movable relative to said product collection housing.

24. The stacker assembly as set forth in claim 23 wherein said cylinder assembly includes a first port and a second port, wherein fluid is selectively supplied to one of said first port and said second port to move said piston relative to said cylinder, and wherein said stacker assembly further comprises a stack plate valve operable to selectively control fluid flow to said one of said first port and said second port to control movement of said stack plate.

25. A product sorting apparatus for sorting products, each product having opposite faces and a bottom edge, the products being conveyed to said product sorting apparatus by a conveyor assembly, the conveyor assembly including a lower member engageable with the bottom edge of each product to support the product, the conveyor assembly supporting the products in a conveying position in which one face of each product is in a non-horizontal orientation, said product sorting apparatus comprising:

a first product collection assembly including a first product collection housing in which products are collected, and a first diverter assembly for selectively diverting a product into said first product collection housing, said first diverter assembly including a diverter mechanism supported adjacent the conveyor assembly, said diverter mechanism including an air knife selectively producing an air flow against one face of a product to divert the product from the conveyor assembly and into said first product collection housing; and a second product collection assembly including a second product collection housing in which products are collected, and a second diverter assembly for selectively diverting a product into said second product collection housing, said second diverter assembly including a second diverter mechanism supported adjacent the conveyor assembly and being operable to divert a product from the conveyor assembly and into said second product collection housing;

wherein said first product collection assembly is a stacker assembly including a product collection housing defining a housing axis, and a stack plate providing a bottom wall in said product collection housing, said stack plate being movable relative to said product collection housing along said housing axis.

26. The product handling apparatus as set forth in claim 25 wherein said second product collection assembly is a product sort bin including a product collection housing including spaced apart side walls, a bottom wall and a movable front wall cooperating to define a product collection compartment.

27. The product handling apparatus as set forth in claim 25 wherein said second product collection assembly is a second stacker assembly including a second product collection housing defining a second housing axis, and a second stack plate providing a bottom wall in said second product collection housing, said second stack plate being movable relative to said second product collection housing along said second housing axis.

28. The product handling apparatus as set forth in claim 27 and further comprising a third product collection assembly including a third product collection housing in which products are collected, said third product collection housing including spaced apart side walls, a bottom wall and a movable front wall cooperating to define a product collection compartment, and a third diverter assembly for selectively diverting a product into said third product collection housing, said third diverter assembly including a third diverter mechanism supported adjacent the conveyor assembly and being operable to divert a product from the conveyor assembly and into said third product collection housing.

29. The product handling apparatus as set forth in claim 25 and further comprising a controller for controlling said first diverter mechanism and said second diverter mechanism to selectively and alternatively divert products into said first product collection housing and said second product collection housing, respectively.

30. A conveyor assembly for conveying products in a product handling apparatus, each product having opposite faces and a bottom edge, a top edge, a leading edge and a trailing edge, said conveyor assembly defining a conveyor axis, said conveyor assembly comprising:

a first conveyor belt for supporting and conveying a product through a first portion of the product handling apparatus, said first conveyor belt having a first belt surface and a plurality of first cleat members spaced apart along said conveyor axis and extending from said first belt surface, said first belt surface being engageable with the bottom edge of the product to support the product and one of said plurality of first cleat members being engageable with the trailing edge of the product;

a first drive sprocket drivingly engaging said first conveyor belt;

a second conveyor belt for supporting and conveying the product through a second portion of the product handling apparatus, said second conveyor belt having a second belt surface and a plurality of second cleat members spaced apart along said conveyor axis and extending from said second belt surface, said second belt surface being engageable with the bottom edge of the product to support the product and one of said plurality of second cleat members being engageable with the trailing edge of the product;

a second drive sprocket drivingly engaging said second conveyor belt; and a drive motor having a rotatable drive shaft drivingly engaging said first drive sprocket and said second drive sprocket;

wherein, as said drive shaft drives said first drive sprocket and said second drive sprocket, said first conveyor belt and said second conveyor belt are moved so that said plurality of first cleat members and said plurality of second cleat members are respectively moved, and wherein movement of said plurality of first cleat members and said plurality of second cleat members is initially synchronized so that said second conveyor belt receives the product from said first conveyor belt.

31. The conveyor assembly as set forth in claim 30 and further comprising:

a first support member extending substantially parallel to said first conveyor belt and having a smooth, low friction first support surface engageable with one face of the product to support the product in a conveying position in which the one face is in a non-horizontal orientation; and a second support member extending substantially parallel to said second conveyor belt and having a smooth, low friction second support surface engaging the one face of the product to support the product in the conveying position in which the one face is in the non-horizontal orientation.

32. The conveyor assembly as set forth in claim 30 wherein said conveyor assembly supports the product in the conveying position in which the one face of the product is angled at least 70° from a horizontal plane and is in a non-vertical orientation.

33. The conveyor assembly as set forth in claim 30 wherein said first conveyor belt is offset from said second conveyor belt relative to said conveyor axis, and wherein said conveyor assembly further comprises an angled guide member having a smooth, low friction guide surface engageable with one face of the product to support the product in a conveying position in which the one face is in a non-horizontal orientation and to guide the product from said first conveyor belt to said second conveyor belt.

34. The conveyor assembly as set forth in claim 32 wherein said conveyor assembly supports the product in the conveying position in which the one face of the product is angled at least about 20° from a vertical plane.

35. A conveyor assembly for conveying products in a product handling apparatus, each product having opposite faces and a bottom edge, a top edge, a leading edge and a trailing edge, said conveyor assembly defining a conveyor axis, said conveyor assembly comprising:

a first conveyor belt for supporting and conveying a product through a first portion of the product handling apparatus, said first conveyor belt having a first belt surface and a plurality of first cleat members spaced apart along said conveyor axis and extending from said first belt surface, said first belt surface being engageable with the bottom edge of the product to support the product and one of said plurality of first cleat members being engageable with the trailing edge of the product;

a first drive sprocket drivingly engaging said first conveyor belt;

a second conveyor belt for supporting and conveying the product through a second portion of the product handling apparatus, said second conveyor belt having a second belt surface and a plurality of second cleat members spaced apart along said conveyor axis and extending from said second belt surface, said second belt surface being engageable with the bottom edge of the product to support the product and one of said plurality of second cleat members being engageable with the trailing edge of the product;

a second drive sprocket drivingly engaging said second conveyor belt;

a drive motor having a rotatable drive shaft drivingly engaging said first drive sprocket and said second drive sprocket;

a first support member extending substantially parallel to said first conveyor belt and having a smooth, low friction first support surface engageable with one face of the product to support the product in a conveying position in which the one face is in a non-horizontal orientation;

a second support member extending substantially parallel to said second conveyor belt and having a smooth, low friction second support surface engaging the one face of the product to support the product in the conveying position in which the one face is in the non-horizontal orientation;

wherein, as said drive shaft drives said first drive sprocket and said second drive sprocket, said first conveyor belt and said second conveyor belt are moved so that said plurality of first cleat members and said plurality of second cleat members are respectively moved, and wherein movement of said plurality of first cleat members and said plurality of second cleat members is initially synchronized so that said second conveyor belt receives the product from said first conveyor belt;

wherein said first conveyor belt and said second conveyor belt convey products in a first conveying direction, and wherein said conveyor assembly further comprises:

a third conveyor belt for supporting and conveying the product through a third portion of the product handling apparatus in a second conveying direction, said second conveying direction being opposite to said first conveying direction, said third conveyor belt having a third belt surface and a plurality of third cleat members spaced apart along said conveyor axis and extending from said third belt surface, said third belt surface being engageable with the bottom edge of the product to support the product and one of said plurality of third cleat members being engageable with the trailing edge of the product; and a turning guide assembly supported to receive products from said second conveyor belt and said second support member in said first conveying direction and in the conveying position in which the one face is in the non-horizontal orientation and to transfer the products to said third conveyor belt in said second conveying direction and in the conveying position in which the one face is in the non-horizontal orientation, said turning guide including an upper turning guide support member having a smooth, low friction upper support surface engaging the one face of the product to support the product in the conveying position in which the one face is in the non-horizontal orientation, and a lower turning guide member engaging the bottom edge of the product to support the product.

36. A conveyor assembly for conveying products in a product handling apparatus, each product having opposite faces and a bottom edge, a top edge, a leading edge and a trailing edge, said conveyor assembly defining a conveyor axis, said conveyor assembly comprising:

a first conveyor belt for supporting and conveying a product through a first portion of the product handling apparatus, said first conveyor belt having a first belt surface and a plurality of first cleat members spaced apart along said conveyor axis and extending from said first belt surface, said first belt surface being engageable with the bottom edge of the product to support the product and one of said plurality of first cleat members being engageable with the trailing edge of the product;

a first drive sprocket drivingly engaging said first conveyor belt;

a second conveyor belt for supporting and conveying the product through a second portion of the product handling apparatus, said second conveyor belt having a second belt surface and a plurality of second cleat members spaced apart along said conveyor axis and extending from said second belt surface, said second belt surface being engageable with the bottom edge of the product to support the product and one of said plurality of second cleat members being engageable with the trailing edge of the product;

a second drive sprocket drivingly engaging said second conveyor belt;

a drive motor having a rotatable drive shaft drivingly engaging said first drive sprocket and said second drive sprocket;

wherein, as said drive shaft drives said first drive sprocket and said second drive sprocket, said first conveyor belt and said second conveyor belt are moved so that said plurality of first cleat members and said plurality of second cleat members are respectively moved, and wherein movement of said plurality of first cleat members and said plurality of second cleat members is initially synchronized so that said second conveyor belt receives the product from said first conveyor belt;

an upper support member extending substantially parallel to said first conveyor belt and having a smooth, low friction upper support surface engageable with one face of the product to support the product in a conveying position in which the one face is in a non-horizontal orientation; and a strip-off conveyor assembly including a strip-off conveyor belt oriented substantially parallel to said first conveyor belt, said strip-off conveyor belt having a strip-off belt surface and a plurality of strip-off cleat members spaced apart along said conveyor axis and extending from said belt surface, said belt surface being engageable with a portion of one face of a product and one of said plurality of cleat members being engageable with the trailing edge of the product to strip the product from a feeder assembly, said belt surface of said strip-off conveyor being substantially coplanar with said support member, a strip-off drive sprocket drivingly engaging said strip-off conveyor belt, a strip-off drive motor including a strip-off drive shaft drivingly engaging said strip-off drive sprocket, and a lower support member extending substantially parallel to said strip-off conveyor belt and having a smooth, low-friction lower support surface engageable with the bottom edge of the product to support the product, said lower support surface being substantially coplanar with said first belt surface, wherein, as said drive shaft drives said first drive sprocket, said first conveyor belt is moved so that said plurality of first cleat members is moved, wherein, as said strip-off drive shaft drives said strip-off drive sprocket, said strip-off conveyor belt is moved so that said plurality of strip-off cleat members is moved, and wherein movement of said plurality of first cleat members and said plurality of strip-off cleat members is synchronized so that said first conveyor belt receives the product from said strip-off conveyor assembly.

37. A conveyor assembly for conveying products in a product handling apparatus, each product having opposite faces and a bottom edge, a top edge, a leading edge and a trailing edge, said conveyor assembly defining a conveyor axis, said conveyor assembly comprising:

a conveyor belt for supporting and conveying a product through the product handling apparatus, said conveyor belt having a belt surface and a plurality of cleat members spaced apart along said conveyor axis and extending from said belt surface, said belt surface being engageable with the bottom edge of the product to support the product and one of said plurality of cleat members being engageable with the trailing edge of the product; and a support member extending substantially parallel to said conveyor belt and having a smooth, low friction support surface engageable with one face of the product to support the product in a conveying position in which the one face is in a non-horizontal and non-vertical orientation.

38. A product handling apparatus for handling products, each product having opposite faces and a bottom edge, a top edge, a leading edge and a trailing edge, said product handling apparatus comprising:

a feeder assembly for feeding products into said product handling apparatus, said feeder assembly including a feed conveyor assembly including a feed conveyor belt for supporting products in face-to-face relation in a feed stack having a first end and a second end, said feed conveyor belt being engageable with the bottom edge of each product in the feed stack to support the products, said feed conveyor belt feeding products in a feed direction toward the first end of the feed stack, and a strip-off conveyor assembly including a strip-off conveyor belt having a strip-off direction substantially perpendicular to the feed direction, said strip-off conveyor belt having a strip-off belt surface and a plurality of strip-off cleat members spaced apart in the strip-off direction and extending from said strip-off belt surface, said strip-off belt surface being generally coplanar with one face of the product at the first end of the feed stack, said strip-off belt surface being positioned to engage a portion of the one face of the product at the first end of the feed stack and one of said plurality of strip-off cleat members being engageable with the trailing edge of the product to strip the product at the first end of the feed stack from the feed stack, said strip-off conveyor belt supporting the product in a conveying position in which the one face is in a non-horizontal orientation, a strip-off drive sprocket drivingly engaging said strip-off conveyor belt, a strip-off drive motor including a strip-off drive shaft drivingly engaging said strip-off drive sprocket, and a lower support member extending substantially parallel to said strip-off conveyor belt and having a smooth, low-friction lower support surface engageable with the bottom edge of the product to support the product;

a conveyor assembly for conveying products through said product handling apparatus, said conveyor assembly having a conveyor axis, said conveyor assembly including a first conveyor belt for supporting and conveying a product through a first portion of the product handling apparatus, said first conveyor belt having a first belt surface and a plurality of first cleat members spaced apart along the conveyor axis and extending from said first belt surface, said first belt surface being engageable with the bottom edge of the product to support the product and one of said plurality of first cleat members being engageable with the trailing edge of the product, first belt surface being substantially coplanar with said lower support surface, a first drive sprocket drivingly engaging said first conveyor belt, a first support member extending substantially parallel to said first conveyor belt and having a smooth, low friction first support surface engageable with the one face of the product to support the product in the conveying position in which the one face is in the non-horizontal orientation, said first support surface being substantially coplanar with said strip-off belt surface, a second conveyor belt for supporting and conveying the product through a second portion of the product handling apparatus, said second conveyor belt having a second belt surface and a plurality of second cleat members spaced apart along the conveyor axis and extending from said second belt surface, said second belt surface being engageable with the bottom edge of the product to support the product and one of said plurality of second cleat members being engageable with the trailing edge of the product, a second drive sprocket drivingly engaging said second conveyor belt, a second support member extending substantially parallel to said second conveyor belt and having a smooth, low friction second support surface engaging the one face of the product to support the product in the conveying position in which the one face is in the non-horizontal orientation, and a drive motor having a rotatable drive shaft drivingly engaging said first drive sprocket and said second drive sprocket, wherein, as said drive shaft drives said first drive sprocket and said second drive sprocket, said first conveyor belt and said second conveyor belt are moved so that said plurality of first cleat members and said plurality of second cleat members are respectively moved, wherein movement of said plurality of first cleat members and said plurality of second cleat members is initially synchronized so that said second conveyor belt receives the product from said first conveyor belt, wherein, as said strip-off drive shaft drives said strip-off drive sprocket, said strip-off conveyor belt is moved so that said plurality of strip-off cleat members is moved, and wherein movement of said plurality of first cleat members and said plurality of strip-off cleat members is synchronized so that said first conveyor belt receives the product from said strip-off conveyor assembly;

a labeler assembly for applying a label to a product on said conveyor assembly, said labeler assembly including a label applicator supported adjacent said conveyor assembly and for applying the label with an application force to the one face of the product, a first balancing force applicator supported adjacent said conveyor assembly and for applying a first balancing force to the product to balance the application force and to maintain the product on said conveyor assembly, a pressure applicator supported adjacent said conveyor assembly and downstream of said label applicator, said pressure applicator applying a fixing pressure to the label on the product, and a second balancing force applicator supported adjacent said conveyor assembly and for applying a second balancing force to the product to balance the fixing pressure and to maintain the product on said conveyor assembly; and a product sorting apparatus for sorting products on said conveyor assembly, said product sorting apparatus including a first product collection assembly including a first product collection housing supported adjacent said conveyor assembly and in which products are collected, and first diverter assembly for selectively diverting a product into said first product collection housing, said first diverter assembly including a diverter mechanism supported adjacent said conveyor assembly, said diverter mechanism including an air knife selectively producing an air flow against the one face of a product to divert the product from said conveyor assembly and into said first product collection housing; and a second product collection assembly including a second product collection housing supported adjacent said conveyor assembly and in which products are collected, and a second diverter assembly for selectively diverting a product into said second product collection housing, said second diverter assembly including a second diverter mechanism supported adjacent said conveyor assembly and being operable to divert a product from said conveyor assembly and into said second product collection housing.

* * * * *